US007275797B2

(12) United States Patent
Timmermann et al.

(10) Patent No.: US 7,275,797 B2
(45) Date of Patent: Oct. 2, 2007

(54) LATERAL FILE

(75) Inventors: Dave Timmermann, Nunica, MI (US); Joanna DeWeerd, Fennville, MI (US); Chad J. Potinsky, Holland, MI (US); William L. Cleair, Holland, MI (US); Victor H. Tan, Holland, MI (US); David A. Beurkens, Hudsonville, MI (US); Richard A. Dixon, Zeeland, MI (US)

(73) Assignee: Haworth, Inc., Holland, MI (US)

( * ) Notice: Subject to any disclaimer, the term of this patent is extended or adjusted under 35 U.S.C. 154(b) by 254 days.

(21) Appl. No.: 10/657,014

(22) Filed: Sep. 5, 2003

(65) Prior Publication Data

US 2004/0119385 A1 Jun. 24, 2004

(51) Int. Cl.
*A47B 88/00* (2006.01)

(52) U.S. Cl. ..... 312/351; 312/334.8; 312/257.1; 312/263

(58) Field of Classification Search ..... 312/257.1, 312/263, 350, 351, 330.1, 334.7, 334.8, 216, 312/217, 220

See application file for complete search history.

(56) References Cited

U.S. PATENT DOCUMENTS

| | | | | |
|---|---|---|---|---|
| 1,569,158 A | | 1/1926 | Tobey | 312/240 |
| 1,934,644 A | | 11/1933 | Rand | 312/263 |
| 2,686,704 A | | 8/1954 | Wolters | 312/257.1 |
| 3,572,874 A | * | 3/1971 | Hassel | 312/350 |
| 3,716,284 A | | 2/1973 | Vogt | 312/334.4 |
| 3,819,245 A | | 6/1974 | Tacke et al. | |
| 4,432,590 A | | 2/1984 | Lawrence et al. | |
| 4,662,689 A | * | 5/1987 | Chatterson et al. | 312/219 |
| 4,692,984 A | | 9/1987 | McKernan et al. | |
| 4,712,844 A | | 12/1987 | Fry | 312/265 |
| 4,899,900 A | * | 2/1990 | Debus et al. | 220/4.02 |
| 4,971,404 A | | 11/1990 | Klungle et al. | |
| 5,102,210 A | | 4/1992 | Beals | |
| 5,251,974 A | | 10/1993 | Beals | |
| 5,364,178 A | | 11/1994 | Hofman et al. | |
| 5,775,786 A | * | 7/1998 | Liebertz | 312/334.8 |
| 5,785,401 A | | 7/1998 | Bowyer et al. | |
| 5,853,237 A | | 12/1998 | Powell et al. | |
| 6,293,637 B1 | | 9/2001 | Anderson et al. | |
| 2003/0111941 A1 | * | 6/2003 | Noel et al. | 312/334.4 |

OTHER PUBLICATIONS

One sheet with drawings A and B of a hollow base for a housing, publicly known before Sep. 3, 2002.

* cited by examiner

*Primary Examiner*—Winnie Yip
(74) *Attorney, Agent, or Firm*—Flynn, Thiel, Boutell & Tanis, P.C.

(57) ABSTRACT

A lateral file having a cabinet structure which provides improved rigidity against racking, including an improved upright boxlike housing having an improved base associated therewith. The housing has opposed sidewall structures which are defined by identical one-piece monolithic structures each having a generally planar and upright exterior side wall with a pair of channel-like uprights fixed to an inside surface thereof and extending vertically along the exterior side wall adjacent opposite edges thereof. The upright channels and the exterior side wall are formed as a monolithic one-piece structure from a monolithic piece of sheet steel, such as by roll forming. The sidewall structure is generally symmetrical about a vertically extending centerline so that identical sidewall structures can define both the right and left sides of the housing.

21 Claims, 16 Drawing Sheets

LATERAL FILE

CROSS-REFERENCE TO RELATED APPLICATION

This application is related to commonly-owned application Ser. No. 10/328 736, filed Dec. 23, 2002, issued as U.S. Pat. No. 6,877,831 and entitled "HOUSING FOR FREE-STANDING FILE CABINET".

FIELD OF THE INVENTION

This invention relates to a storage cabinet, particularly a drawer-type lateral file storage cabinet of the type used in offices and the like, and to an improved housing or casing for such cabinet so as to significantly improve strength and rigidity thereof relative to racking.

This invention also relates to a storage cabinet, particularly a drawer-type lateral file storage cabinet of the type used in offices and the like, and to an improved slotted upright which is attached to the cabinet side walls and detachably supports telescopic drawer slides for permitting all of the slide-engaging uprights to be of identical construction.

This invention further relates to an improved storage cabinet housing and a process for manufacturing a storage cabinet housing, particularly for a drawer-type lateral file cabinet of the type used in offices and the like, wherein the cabinet housing is constructed using separate but identical upright sidewall structures for defining both the right and left sides of the housing, with each upright sidewall structure having identical front and rear uprights integrated therewith for simplifying the overall construction process by minimizing both the number of separate parts and the associated assembly requirements.

BACKGROUND OF THE INVENTION

Drawer-type storage cabinets, commonly referred to as vertical files or lateral files, are conventionally utilized in offices and the like for storage of papers and other documents. The storage cabinet known as a lateral file is commonly and frequently utilized since the dimensional relationship of such file contributes to its being more user friendly. More specifically, such lateral file has the length of the file drawer extending generally parallel with the open side of the housing, whereby the housing has an overall depth which is generally significantly less than the length thereof. This enables the individual drawers to be more readily accessible throughout the full length thereof, and at the same time the drawers when extended outwardly into an open position are cantilevered outwardly through a lesser extent than is experienced when opening the drawer of a conventional vertical file.

More specifically the lateral file, as a result of its geometric arrangement, has an upright hollow housing defined generally by parallel upright side walls which are rigidly joined together by top and bottom walls, and which are typically joined by a back wall, the latter frequently being a thin metal sheet. The front side of the upright hollow housing is defined by a large access opening which occupies substantially the entirety of the front side, whereby a plurality of horizontally movable drawer units are supported in vertically superimposed relationship within the interior of the housing whereby the drawer fronts are positioned vertically one above the other so as to close off the front access opening. This overall geometric relationship, coupled with the desire to minimize the thickness of the individual walls and provide an exterior appearance having desired aesthetics, has necessarily resulted in a casing or housing which typically has less strength and rigidity than desired. Because of this, such lateral files have typically exhibited significant "racking" when subjected to load. That is, the housing tends to angularly deflect sidewardly relative to its base, whereby the side walls lose their perpendicular relationship with respect to the base, and the overall operation and appearance of the file is impaired. This racking becomes particularly significant when the lateral file is relatively high since the geometry of the file, for example its lateral or length dimension being typically two to three times its depth dimension, when coupled with an overall height dimension which is large when the file is four or five drawers high, results in the top of the file being laterally displaced a significant distance relative to the base.

Drawer-type storage cabinets of the type described above also typically utilize a construction wherein the cabinet side walls have opposed pairs of front and rear uprights secured thereto and provided with vertical rows of openings or slots for mounting the telescopic slides which are used for individually slidably supporting the drawers for opening and closing movement. A conventional practice for constructing the cabinet involves the use of four different uprights, namely right and left front uprights which are mirror images of one another and have rows of openings therein, as well as right and left rear uprights which are also mirror images of one another and have rows of elongate slots formed therein. These four uprights are all uniquely different from one another and are individually secured, typically welded, to the inner surface of the cabinet sidewall. The use of four different uprights significantly increases manufacturing complexity by increasing the number of different parts required, and the overall handling and sequencing thereof during assembly.

In an effort to somewhat simplify the construction, some conventional cabinets have identical right and left rear uprights so that only three different parts are required. To accomplish this, however, each of the rear uprights is provided with two vertically extending rows of elongate slots associated therewith, only one of which is used depending upon whether the upright is mounted on the right side versus the left side of the cabinet. While this construction hence does somewhat reduce the number of different parts, nevertheless it increases the manufacturing complexity of the rear upright by requiring forming of two slot rows therein, only one of which is used when the upright is assembled to the cabinet. Current cabinet constructions, whether they use three different or four different uprights, hence involves a significant number of different parts which hence complicates the overall manufacturing process.

The known assembly processes for constructing conventional storage cabinets, particularly drawer-type lateral file cabinets, have also frequently utilized separate right and left upright sidewall members which are frequently mirror images due to their defined right and left characteristics, and which typically have separate but distinct front and rear uprights secured to the sidewall member, such as by welding. Such constructions hence involve manufacturing processes which are undesirably complex due to the number of distinct parts which make up the cabinet structure, and the associated assembly steps required to fixedly join the parts. The assembly processes associated with the known cabinet structures have hence involved a greater degree of complexity and cost than desired.

Accordingly, it is an object of this invention to provide an improved housing or cabinet structure for a storage unit, particularly a drawer-type lateral file, which overcomes or at least significantly improves the strength of the housing so as to significantly minimize the racking problem conventionally encountered when the file is under load.

More specifically, this invention relates to an improved lateral file having an improved housing or cabinet structure which provides improved rigidity so as to minimize lateral displacement or racking of the housing structure under load, with the improved racking resistance being achieved principally through an improved base wall structure which is rigidly associated with the hollow boxlike housing. The bottom wall structure of the present invention is preferably defined as a closed but generally hollow box which extends across the bottom of the housing and has a thin vertical profile. The closed hollow box additionally has wall structure which defines closed tubelike channels extending lengthwise along at least opposite edges thereof, whereby the box provides significant strength with respect to vertical or downward compression loads imposed thereon, and in addition possesses strength and rigidity to more thoroughly rigidify the hollow boxlike housing so as to significantly minimize lateral racking thereof.

In the improved lateral file of the present invention, as aforesaid, the closed boxlike structure defining the bottom wall of the housing is defined solely by upper and lower boxlike members which are each open on one side. The open boxlike members are disposed in opposed relationship and nested one within the other, and rigidly joined together, to define a generally closed but hollow box which, when rigidly secured to lower edges of the side and back walls of the casing, provide improved resistance against lateral racking of the housing.

In the improved lateral file of this invention, as aforesaid, the opposed and nested upper and lower box members also have edge flanges extending around each of the members, which edge flanges cooperate with the opposite member to define, within the interior of the closed box, a closed tubelike channel structure which extends longitudinally along each of the edges of the box so as to provide the closed box with significantly increased strength and rigidity in both the lengthwise and widthwise dimensions thereof.

In the improved closed box structure defining the bottom wall of the housing, as aforesaid, the closed box structure is defined in its entirety by two members, namely the opposed upper and lower box members, which facilitates both economy and efficiency of manufacture and assembly, and in addition the two box members can be constructed of different thickness materials (for example different gauge sheet metal) so as to optimize strength versus cost and weight.

It is a further object of this invention to provide an improved housing or cabinet structure for a drawer-type file, particularly a lateral file, which provides improved efficiency of manufacture and construction due to the use of four identical uprights for defining the opposed pairs of front and rear uprights which support the telescopic drawer slides, whereby only a single upright member is required for manufacture and the same upright can be used as a front or rear upright on either the right or left sides of the cabinet. The upright utilizes and provides only a single row of openings extending vertically therealong for cooperating with the front or rear of either the right or left drawer slide, thereby decreasing the number of different parts required, and facilitating efficient manufacture and assembly of the cabinet.

More specifically, this invention relates to an improved lateral file having an improved housing or cabinet structure which has identical front and rear uprights fixed to the inner surfaces of each of the right and left side walls of the cabinet, with each upright having an identical single vertically-extending row of openings therethrough so that each upright is capable of engaging either a front or rear tab associated with an elongate housing of either the right or left telescopic drawer slide. The front and rear uprights, which are all preferably of channel-like cross section, are secured as by welding to the respective side wall so that the front uprights are disposed on opposite sides of the cabinet in opposed relationship adjacent the front opening, whereas the rear uprights are disposed in opposed relationship adjacent the rear side of the cabinet. The drawer slide housing has a first horizontally projecting tab which projects rearwardly adjacent the rearward end thereof for insertion into one of the openings associated with a rear upright, and has a front downwardly-projecting tab for projection through an identical opening associated with the front upright to stationarily and stably secure the telescopic slide to the uprights.

It is still a further object of the invention to provide an improved process for manufacturing the housing or cabinet structure, such as for a drawer-type lateral file, which process includes providing a pair of identical upright one-piece sidewall structures each of which can be used to define either the right or left side of the housing, with each sidewall structure having a pair of substantially identical or mirror-image uprights associated therewith adjacent opposite vertical edges thereof so that either upright may function as either a front or a rear upright depending upon the orientation of the sidewall structure during assembly, and providing the uprights on each one-piece side-wall structure by a forming process such as roll forming or the like so that the uprights and the associated side wall define a one-piece integral and monolithic structure formed from sheet metal and more specifically sheet steel. The process reduces the number of different and individual parts which must be manufactured and inventoried, and simplifies the manufacturing process with respect to time, space and efficiency.

Other objects and purposes of the present invention will be apparent to persons familiar with constructions of this general type upon reading the following specification and inspecting the accompanying drawings.

Figure 1:
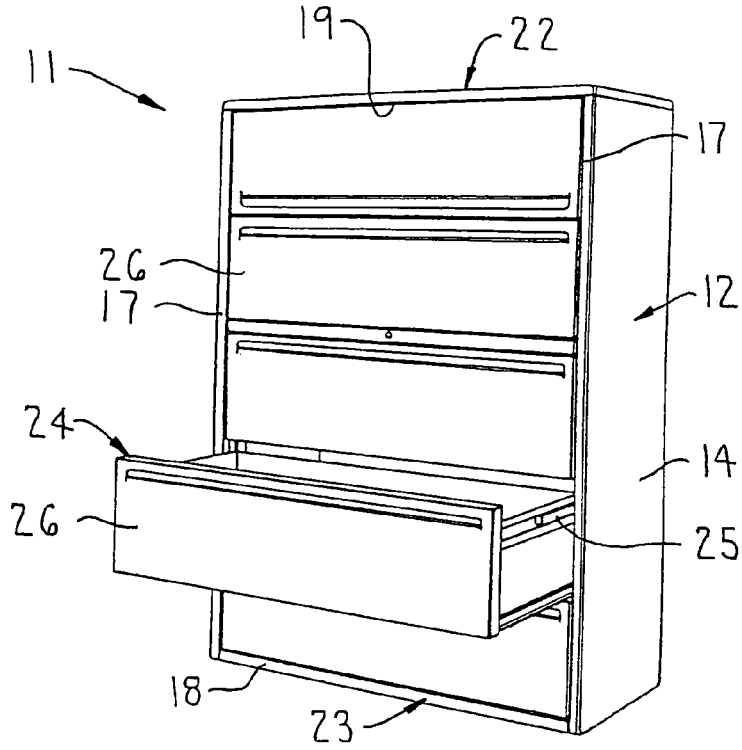
FIG. 1 is a perspective view of a first embodiment of a free-standing cabinet, specifically a drawer-type lateral file cabinet.

Certain terminology will be used in the following descriptions for convenience in reference only, and will not be limiting. For example, the words "upwardly", "downwardly", "rightwardly" and "leftwardly" will refer to directions in the drawings to which reference is made. The word "front" will refer to that side of the cabinet having an access opening which accommodates the drawer fronts. The words "inwardly" and "outwardly" will refer to directions toward and away from, respectively, the geometric center of the cabinet and designated parts thereof. Said terminology will include the words specifically mentioned, derivatives thereof, and words of similar import.

DETAILED DESCRIPTION

A first embodiment of a storage unit and more specifically a drawer-type unit will now be described with reference to FIGS. 1-12.

Referring initially to FIGS. 1-5, there is illustrated a free-standing drawer-type file cabinet 11, commonly known as a lateral file cabinet. The cabinet 11 includes an upright hollow boxlike housing 12 having a substantially planar upright back wall 13 and opposed substantially parallel upright side walls 14, the latter being joined to the back wall by rear corners 15. The side walls 14, at their forward edges, in the illustrated embodiment, have rounded front corners 16 defining narrow vertically-extending front edge strips 17 which are associated with the front side or wall 18 of the housing 12. The front edge strips 17 define a large front opening 19 therebetween which provides access to the hollow interior 21 of the boxlike housing. This front opening 19 extends horizontally and vertically over substantially the entirety of the respective width and height of the front wall except for narrow wall strips defined around the periphery thereof, such as defined by the vertical front strips 17. The housing 12 also includes top and bottom wall structures 22 and 23, respectively, which are fixed to and close off opposite ends of the housing.

The housing 12 mounts thereon a plurality of horizontally slidable drawer units 24, with a typical lateral file cabinet normally employing from two to five such drawer units positioned generally vertically one above the other within the housing. Each drawer unit 24 is conventionally horizontally slidably supported for movement relative to the housing 12 by a pair of conventional telescopic slide devices 25 which connect between the side walls 14 of the housing and the opposed respective side walls of the drawer unit 24. The drawer unit 24 also has a front wall 26 which, when the drawer unit is in a closed position, is disposed within the front cabinet opening 19 so as to be substantially flush with the front wall 18. The telescopic support devices 25, however, enable the individual drawer units 24 to be horizontally slidably moved outwardly through the front opening 19 into an open position, such as depicted by one of the drawer units in FIG. 1, to provide access to the interior of the drawer unit.

Figure 2:
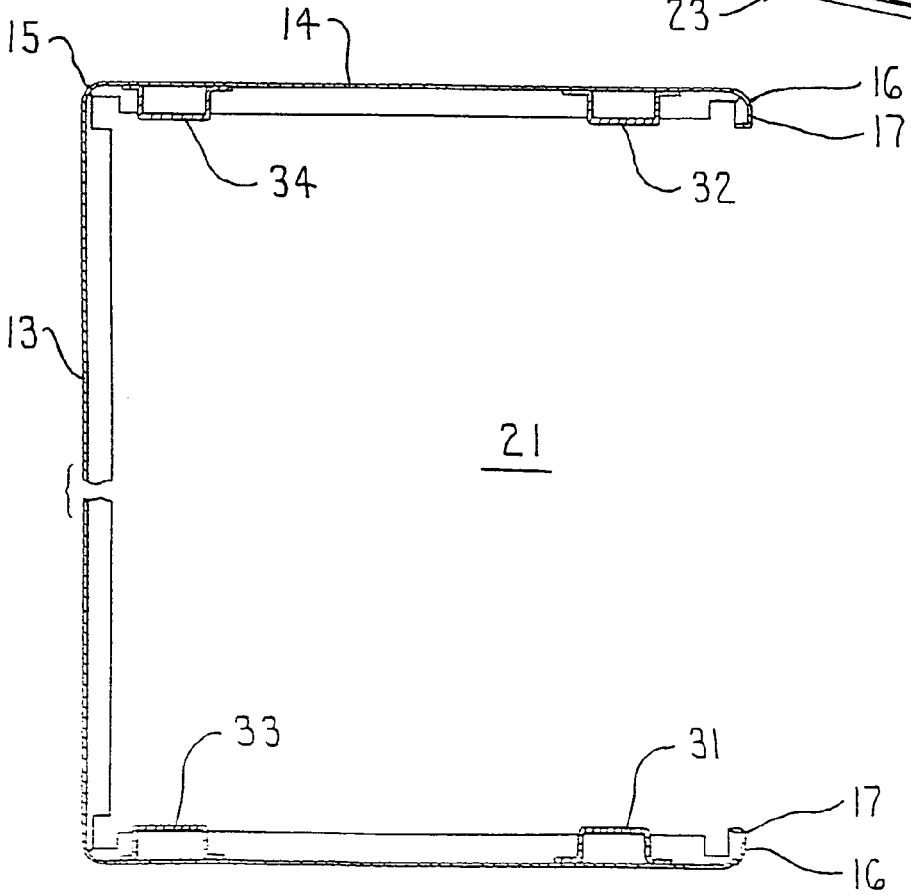
FIG. 2 is a horizontal cross-sectional view showing the U-shaped configuration of the fabricated sidewall structure of the cabinet.
Figure 3:
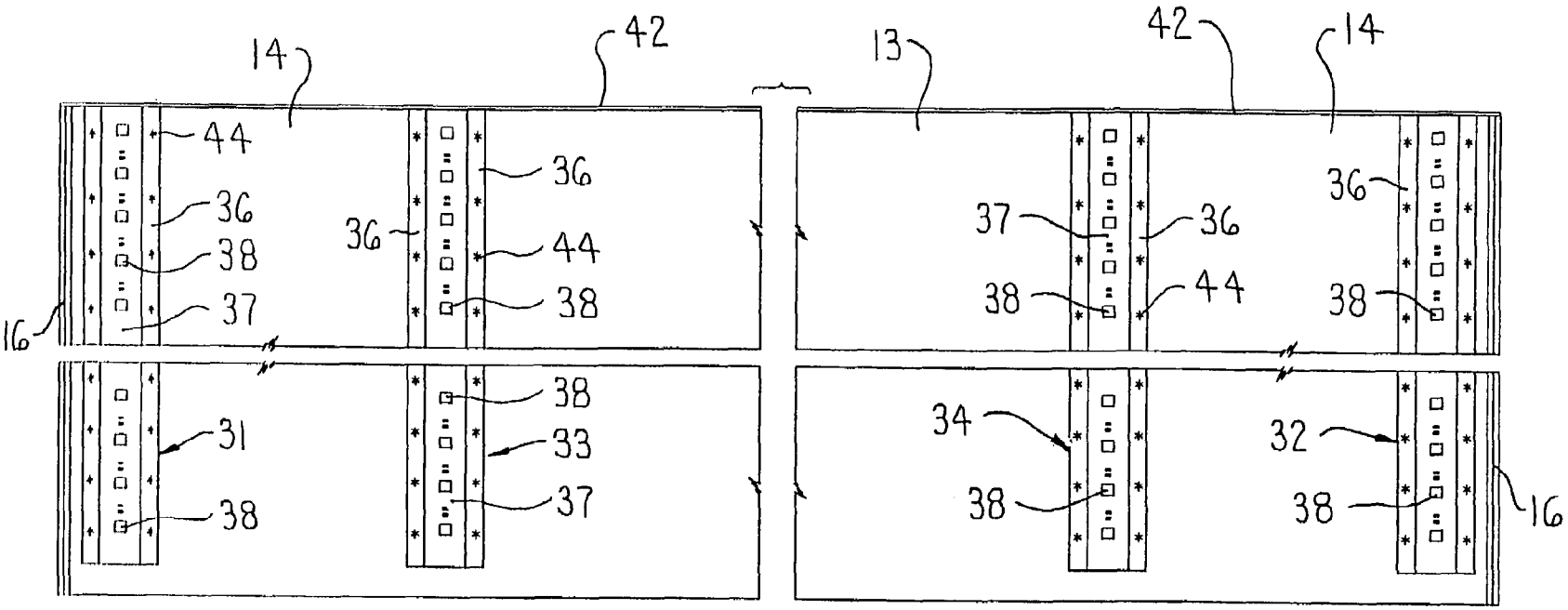
FIG. 3 illustrates the sidewall structure partially fabricated but prior to being bent into a U-shape.

The sidewall structure of the housing 12 as defined by the rear wall 13 and side walls 14 is, in the illustrated embodiment, initially formed in one piece from a flat steel sheet which is suitably folded and deformed to define the rear and side walls, with the sheet being suitably bent to define the rear corners 15 and hence result in the rear and side walls being of an upright U-shaped configuration substantially as illustrated in FIG. 2.

The overall construction of the file cabinet 11, as described above, is conventional. Reference is made to U.S. Pat. No. 4,692,984, owned by the Assignee hereof, for further description of this conventional construction.

To provide support for the horizontally slidable drawer units 24, the housing 12 fixedly mounts therein a plurality of uprights 31-34 which are fixed to and project vertically along the inner sides of the side walls 14 so as to provide engagement points for the telescopic slide units 25. More specifically, front uprights 31 and 32 are secured to the respective housing side walls 14 in closely adjacent relationship to the front side of the housing, with these uprights 31 and 32 being disposed in opposed or facing relationship. In similar fashion a pair of rear uprights 33-34 are secured to the side walls 14 in opposing relationship adjacent the rear wall 13. The uprights all extend vertically in generally parallel relationship throughout substantially the entire vertical extent of the interior of the housing.

In accordance with the present invention, all of the uprights 31-34 are identical, and each is defined generally as a main U-shaped channel 37 which opens toward the respective side wall 14, with the channel 37 having securing flanges 36 which extend lengthwise therealong and project transversely outwardly therefrom. These side flanges 36 seatingly abut the inner surface of the respective side wall 14 to permit fixed securement of the channel to the side wall, such as by a series of spot welds 44. The base wall 39 of the U-shaped channel is spaced inwardly a small distance from the respective side wall 14 to define a small clearance therebetween. The base wall 39 has a series of small openings 38 formed therethrough, which openings are disposed in generally uniformly vertically spaced relationship and are oriented to define a vertically extending row positioned generally along the vertically extending centerline 35 of the upright.

Figure 4:
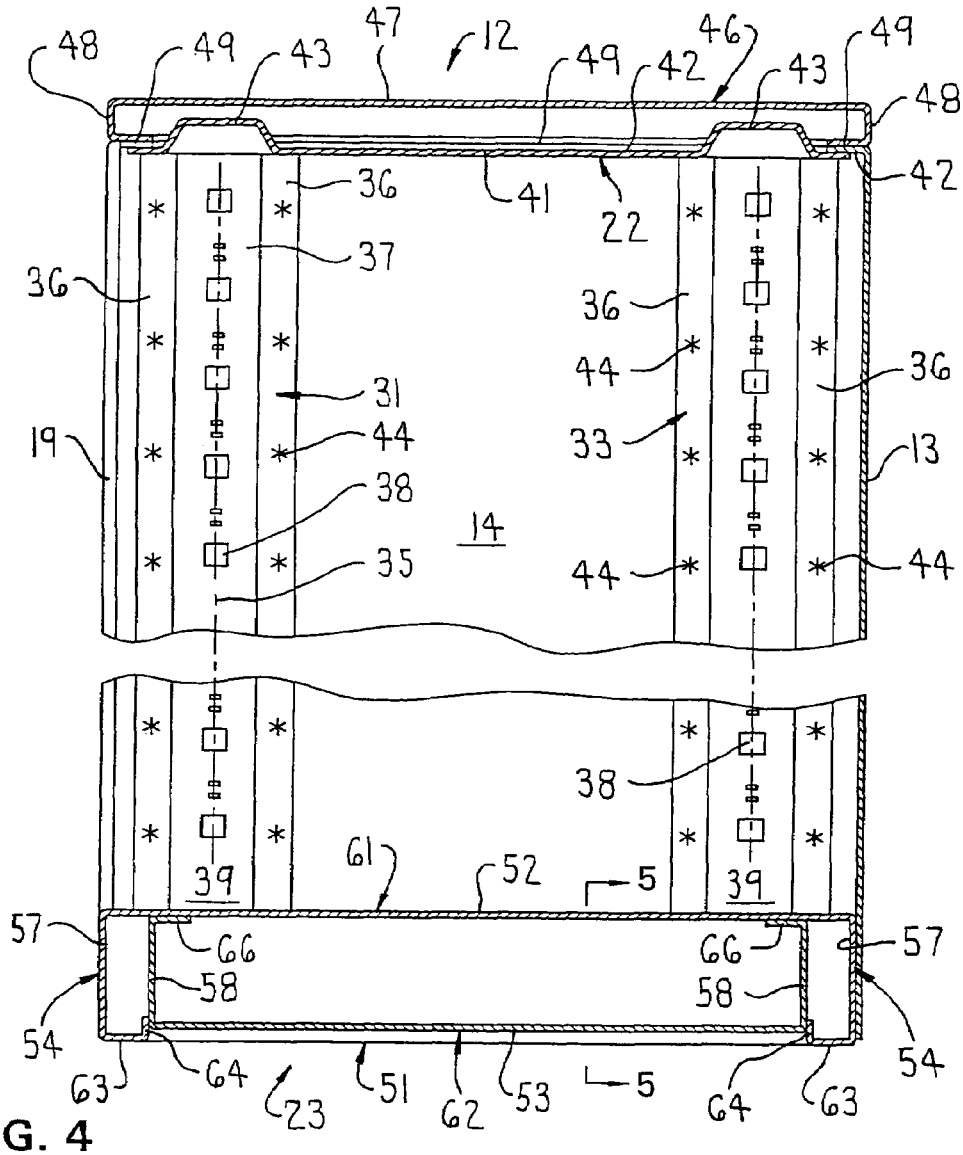
FIG. 4 is an enlarged upright cross-sectional view taken transverse to the front side of the cabinet and shown with the drawers removed.

The identical uprights 31-34 each have a generally hat-shaped cross-section and, since each has an identical configuration which is symmetrical about the respective vertically extending centerline 35 thereof, each upright can be utilized to define either a front or rear upright on either of the right or left side walls 14 of the housing. When mounted on the housing side walls, substantially as illustrated by FIG. 4, the lower ends of the uprights are positioned so as to substantially engage an upper surface of the bottom wall structure 23, as described in detail hereinafter.

The top wall structure 22 as associated with the housing 12 includes a horizontally enlarged platelike top wall 41 which extends longitudinally between the upper edges of the side walls 14, and has a transverse width which horizontally extends throughout the depth of the housing. This top wall 41 is positioned so that the peripheral edge portions thereof are disposed directly under top edge flanges 42 (FIG. 4) which are associated with the upper edges of the rear wall 13 and side walls 14 and are bent so as to project horizontally inwardly through a small extent. The top housing flanges 42 hence overlie peripheral edge portions of the top wall 41 and are suitably fixed thereto, such as by spot welding.

The top wall 41 is preferably provided with a pair of upwardly-protruding channel-like ribs 43, the latter extending in the longitudinal direction of the housing so as to extend perpendicularly between the parallel side walls 14. The channel-like ribs 43 in the illustrated embodiment are positioned so that the longitudinal centerlines thereof respectively intersect the vertical centerlines of the uprights 31-34. Ribs 43 provide top wall 41 with significantly increased strength and rigidity, which top wall in turn when welded to the top flanges associated with the housing back and side walls hence in turn closes off the upper end of the housing to provide a rigidified structure.

The cabinet housing 12 also includes a top cover member 46 which fixedly but detachably secures to the upper end of the housing 12. This top cover member 46 is formed generally as a one-piece open box which opens downwardly, and which can be suitably formed from a single metal sheet. The cover member 46 includes a horizontally extending platelike top wall 47 which extends coextensively over the longitudinal and depth dimensions of the housing. This top wall 47, at its peripheral edges, is bent downwardly to define a peripheral edge wall 48 which extends entirely around the periphery of the top wall and which projects vertically downwardly through only a small vertical extent. The edge wall 48 in turn at its lower end is bent inwardly to define a cantilevered edge flange 49 which is inturned horizontally and which is adapted to be seatingly engaged on top of the top edge flanges 42 associated with the housing walls 13 and 14. The overlapping flanges 42 and 49 are suitably fixedly secured together, typically by screws or other suitable fasteners (not shown) so as to fixedly attach the cover member 46 to the housing 12.

Considering now the bottom wall structure 23 and referring specifically to FIGS. 4-8, this bottom wall structure or base 23 is defined by a closed but hollow box structure 51 which is of small vertical extent but has horizontal dimensions in the longitudinal and depth directions so as to correspond to the horizontal cross section of the housing. The closed box structure 51 includes generally parallel top and bottom walls 52 and 53, respectively, which extend horizontally and are disposed in vertically spaced relation. The top and bottom walls 52-53 in turn are rigidly joined together by horizontally elongate tubular wall arrangements 54 which extend lengthwise along the front and rear longitudinally extending edges of the base, with similar elongated tubular wall arrangements 56 extending lengthwise along the peripheral end (i.e. depthwise) edges of the base. The tubular edge wall arrangements 54 and 56 hence effectively define the periphery of the base and extend in surrounding relationship thereto.

Each of the tubular edge wall arrangements 54 and 56 is defined generally by an outer upright wall 57 which extends vertically throughout the height of the base and defines the longitudinally extending outer peripheral edge wall along each of the front, back and end edges of the base. The tubular wall arrangements 54, 56 also each include an inner upright wall 58 which extends generally parallel with but is spaced inwardly a small distance from the respective outer upright wall 57, with the transverse spacing between the cooperating parallel upright walls 57 and 58 being smaller than the height of these walls in the illustrated and preferred embodiment. The cooperating upright walls 57 and 58 extend generally throughout the vertical height of the base and suitably cooperate with the top and bottom walls of the base to thereby define a substantially closed tubular structure having a generally rectangular cross section, which tubular structure extends throughout substantially the entire length of each of the longitudinal and transverse edges of the base.

The base 51 as briefly described above in effect includes an inner hollow closed box defined by the inner upright walls 58 and their extension between the top and bottom walls 52-53, with this inner closed hollow box being effectively surrounded by the horizontally elongate tubular edge structures 54 and 56 which extend along all of the peripheral edges of the box and which in cooperation with the top and bottom walls 52-53 also effectively define a closed but hollow box.

The closed hollow box 51 according to the present invention is preferably constructed substantially in its entirety from two preformed members, namely upper and lower open box members 61 and 62, respectively, each of which is preferably formed from a suitable flat metal sheet. The upper and lower box members are oriented so that the openings therein are oriented so as to face one another, and these upper and lower box members are sized so that they effectively vertically telescope together whereby the one box member (i.e., the lower box member) effectively nests into the other box member (i.e., the upper box member).

The upper box member 61 is defined by the top wall 52 and the outer upright edge walls 57, with the latter edge walls 57 at their lower ends being suitably deformed inwardly to define inwardly projecting bottom flanges 63 which are generally horizontally oriented so as to be parallel with and displaced vertically downwardly from the top wall 52. The bottom flanges 63 project inwardly only a small horizontal extent, and the inner edges thereof are suitably bent upwardly to define upwardly cantilevered guide flanges 64 which project vertically upwardly through only a small vertical extent and terminate at a free edge. The guide flanges 64 extend generally parallel with and are spaced inwardly a small distance relative to the respective outer upright side flange 57. The construction of the top box member 61, including the top wall 52, outer upright walls 57, bottom flanges 63 and guide flanges 64, are all preferably of a one-piece monolithic structure which is suitably shaped from a flat metal sheet.

The lower box member 62 is defined by the horizontally enlarged bottom wall 53 and the inner upright walls 58 which project upwardly from around the rectangular peripheral edge of the bottom wall 53. The peripheral edge walls 58 of the lower box member, at their upper ends, are bent inwardly to define top flanges 66 which are cantilevered horizontally inwardly and terminate at inner free edges. The lower box member 62, as defined by the bottom wall 53, upright edge walls 58 and top flanges 66, are all preferably formed as a one-piece monolithic structure, such as by being suitably formed from an appropriate flat metal sheet.

Figure 5:
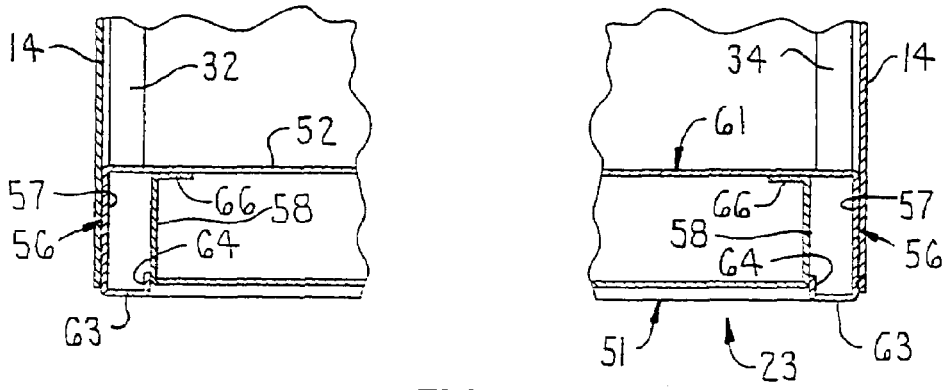
FIG. 5 is a fragmentary sectional view through the base of the cabinet and taken generally along line 5-5 in FIG. 4.
Figure 6:
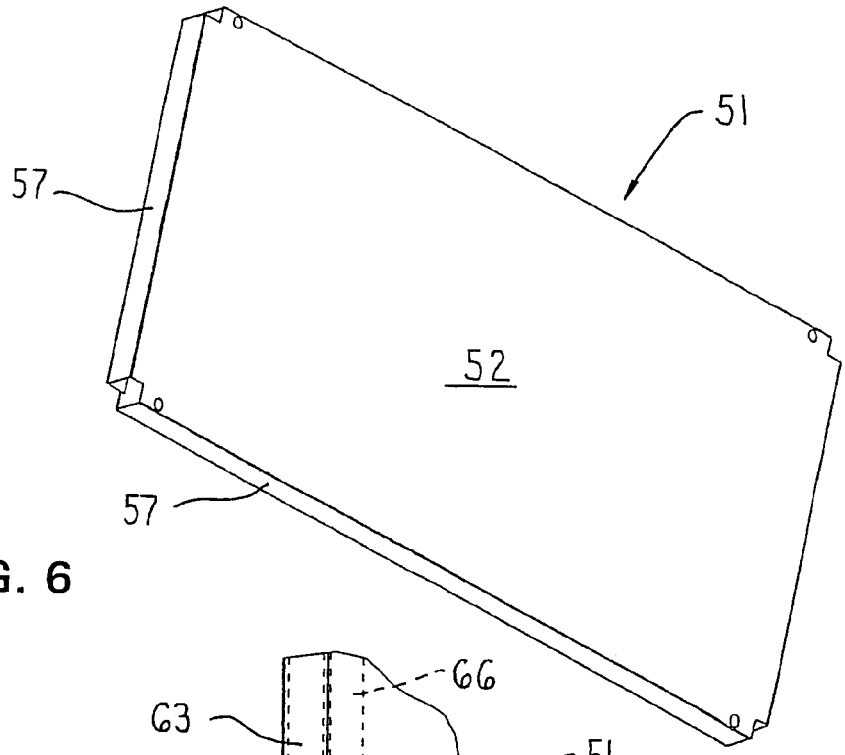
FIG. 6 is a perspective view showing solely the base or boxlike bottom wall structure of the cabinet.

As illustrated by FIGS. 4-5, the upper and lower box members 61 and 62 are sized such that the horizontal exterior cross section of the lower box member 62 substantially corresponds to the interior horizontal cross section defined interiorly of the upper box 61, namely the cross sectional interior defined by the guide flanges 64, whereby the lower box 62 can be slidably inserted into the inverted upper box 61 through the opening defined by the guide flanges 64, with the top flanges 66 on the lower box seating or abutting against the underside of the top wall 52. When so seated, the peripheral upright walls 58 of the inner box, in the vicinity of the bottom wall 53, are disposed effectively in slidably engaged relationship with the inner surfaces of the guide flanges 64. The guide flanges 64 and the adjacent wall structure of the inner box 62 are suitably welded together during assembly of the base so that the inverted nested boxlike members 61 and 62 are hence fixedly joined and hence effectively define a closed hollow boxlike arrangement.

As further illustrated by FIGS. 4-5, the lower box member 62 preferably has a depth which is slightly less than the depth of the upper box member 61 so that, when the box members nest together with the flanges 66 seated against the top wall 52, the bottom wall 53 of the lower box member is preferably spaced upwardly a small distance above the bottom flanges 63 associated with the top box member 61. This hence ensures that the rectangular floor-engaging footprint defined by the lower surfaces of the bottom flanges 63 is hence the primary area which (if the cabinet is not provided with separate glides or feet) can be used for supportive engagement with a floor. Further, this slight upward disposition of the bottom wall 53 relative to the bottom flanges 63 also facilitates the weldment of the bottom box 62 to the guide flanges 64.

Figure 7:
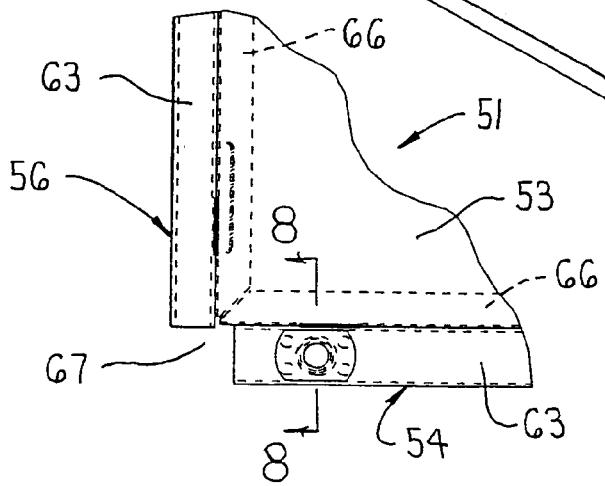
FIG. 7 is a fragmentary view showing solely one corner of the base as appearing from the underside thereof.
Figure 8:
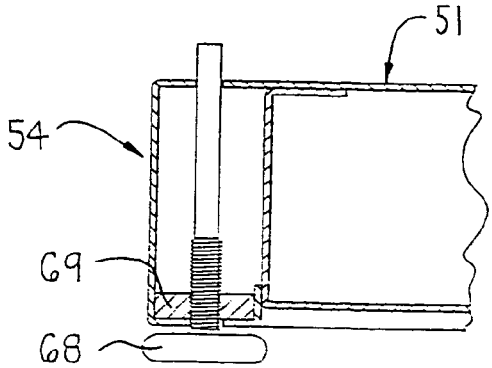
FIG. 8 is a fragmentary sectional view taken generally along line 8-8 in FIG. 7.
Figure 9:
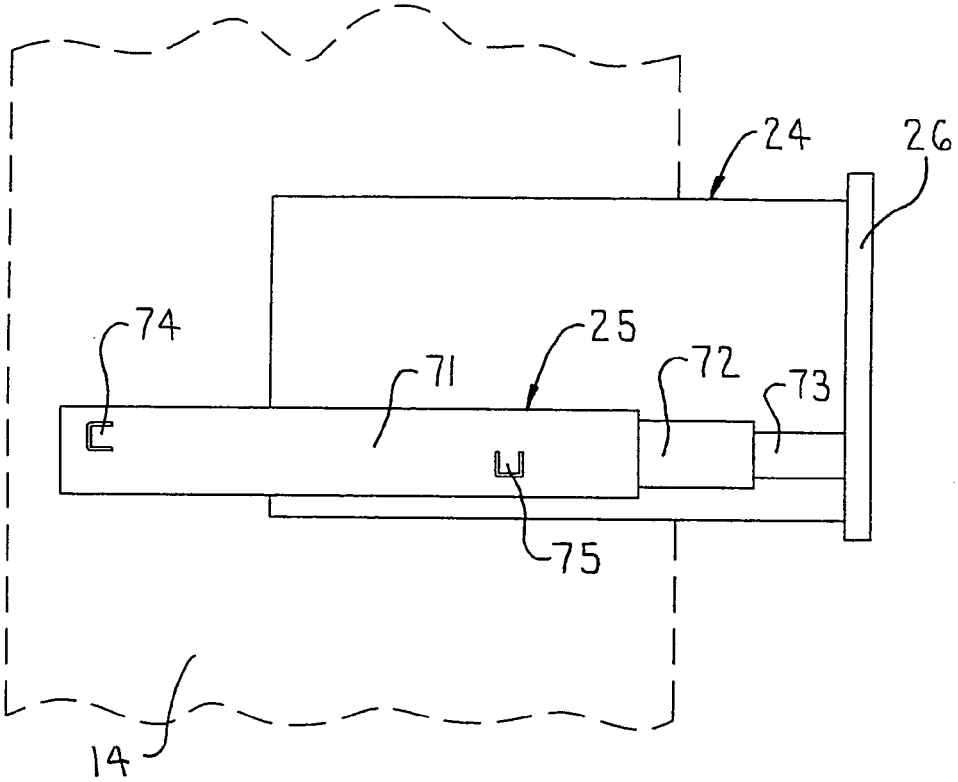
FIG. 9 diagrammatically illustrates a drawer in a partial open condition relative to the cabinet, and showing diagrammatically the drawer slide which interconnects one side of the drawer to an adjacent side wall of the cabinet.
Figure 10:
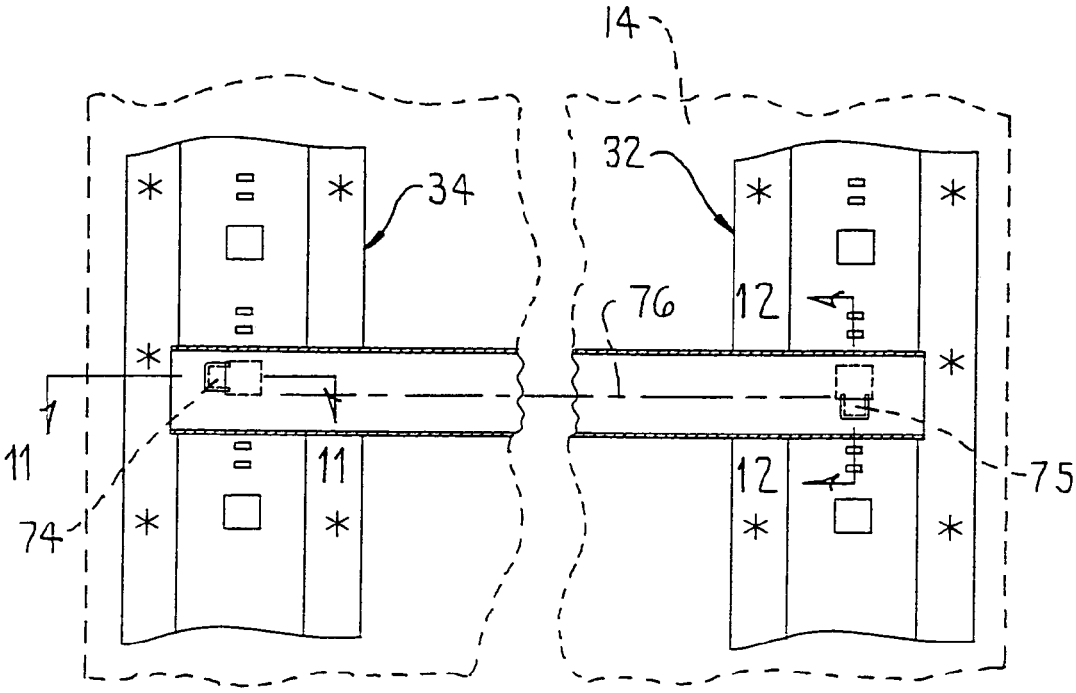
FIG. 10 diagrammatically illustrates a drawer slide attached to a pair of uprights associated with one side wall of the cabinet.
Figure 11:
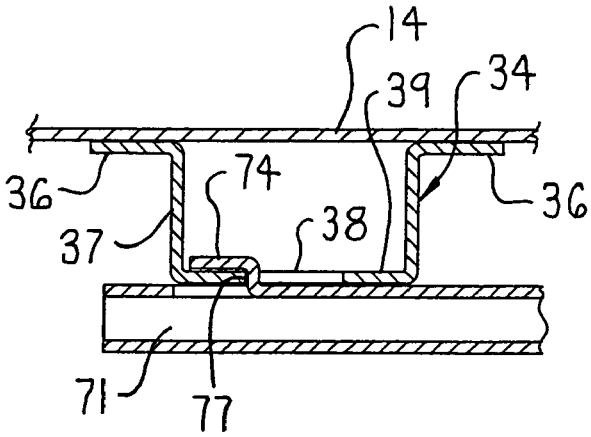
FIGS. 11 and 12 are enlarged, fragmentary sectional views taken along lines 11-11 and 12-12, respectively, in FIG. 10.
Figure 12:
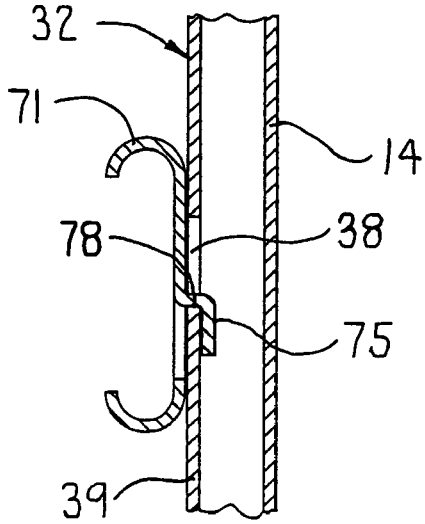
Figure 13:
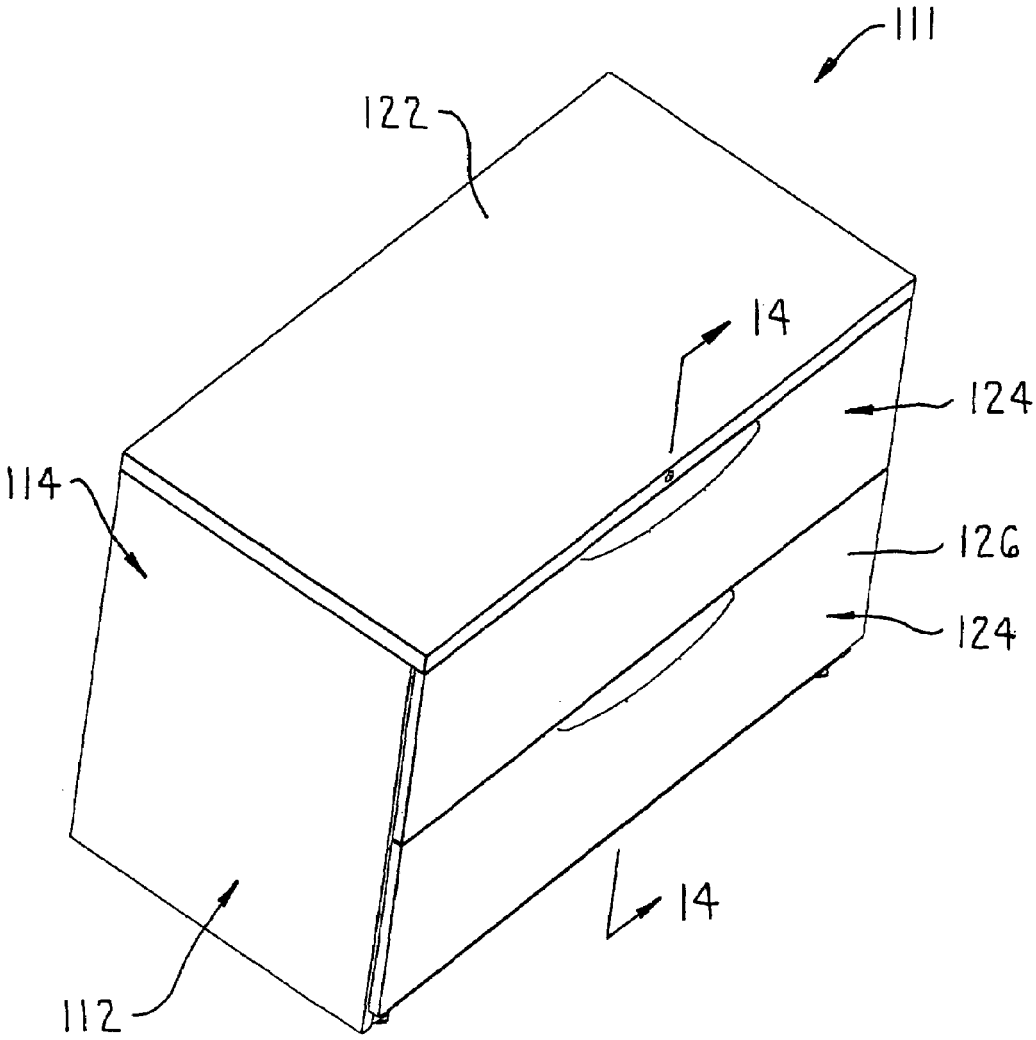
FIG. 13 is a perspective view of a second embodiment of a free-standing cabinet, specifically a drawer-type lateral file cabinet.
Figure 14:
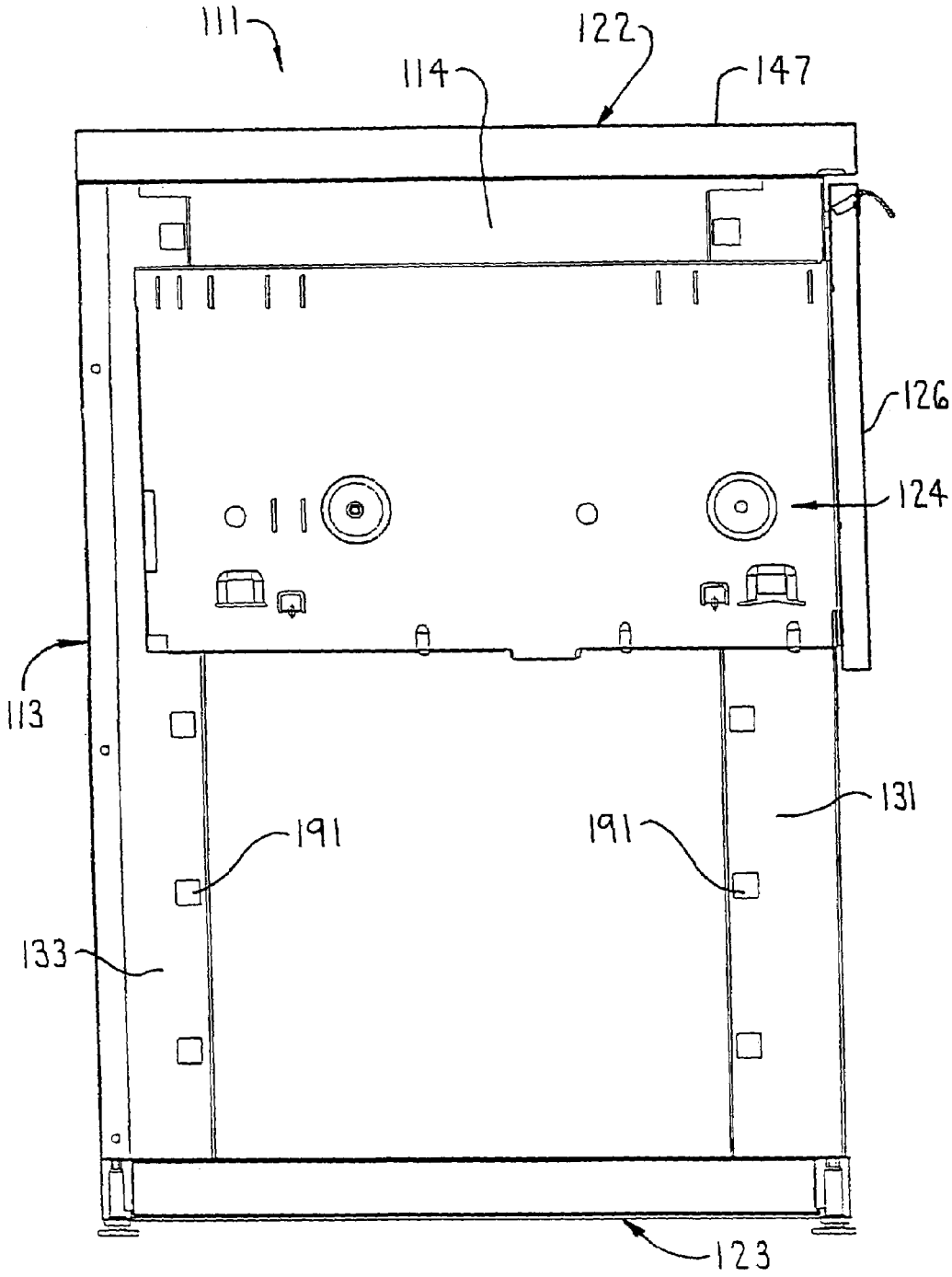
FIG. 14 is a sectional view taken generally along line 14-14 in FIG. 13.
Figure 15:
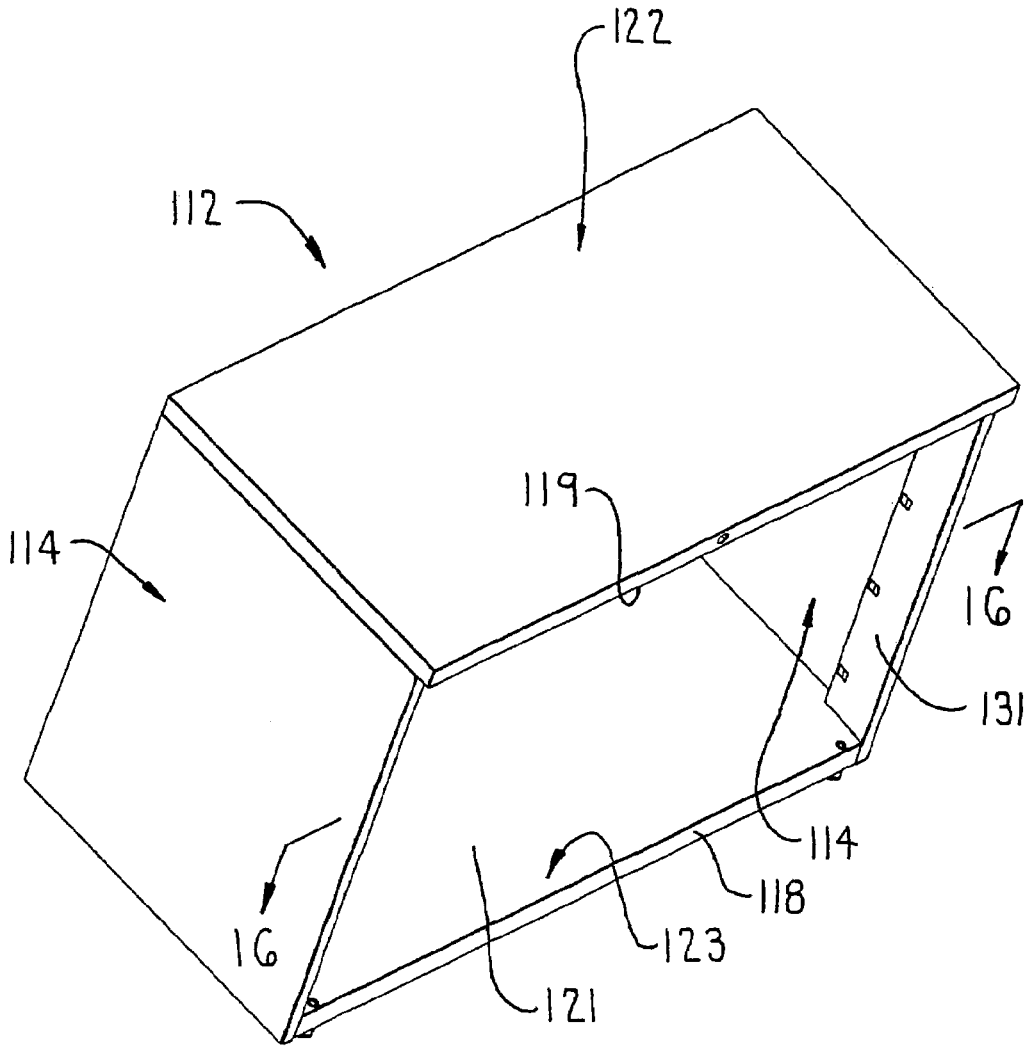
FIG. 15 is a perspective view of the cabinet of FIG. 13 but with the drawers and slides removed.
Figure 16:
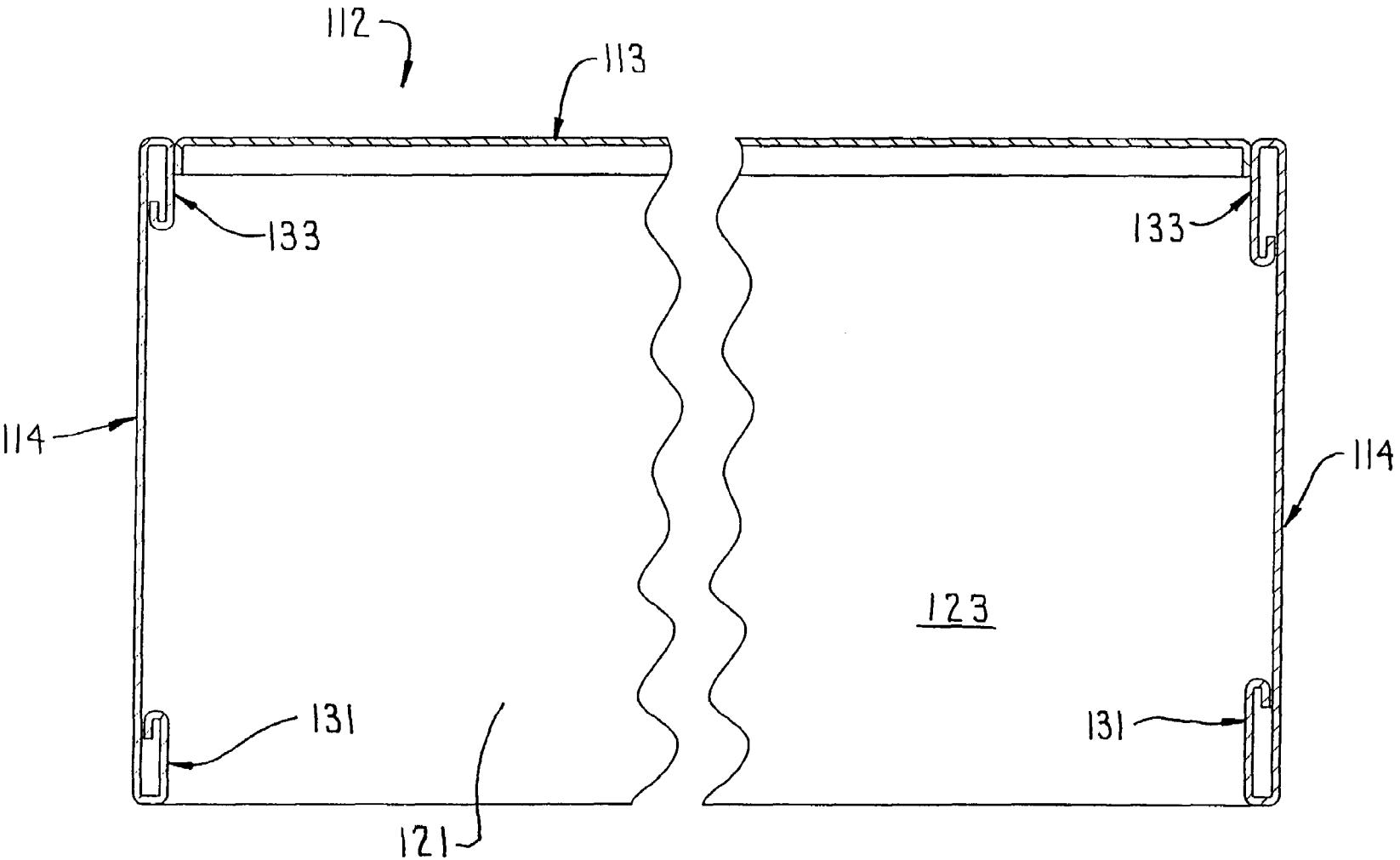
FIG. 16 is a sectional view taken generally along line 16-16 in FIG. 15.

The base 51 is preferably provided with a suitable floor-engaging glide or foot associated with each corner thereof. In this respect, one such glide is illustrated in FIGS. 7-8 wherein the glide 68 is positioned directly below the tubular edge structure 54 of the base closely adjacent one end thereof. The glide 68 has an upwardly projecting shaft which protrudes upwardly through the tubular wall structure 54 and is suitably threadably engaged into and through a nut structure 69 which is fixed to the tubular wall structure. The glide 68 hence can be adjusted vertically to permit proper leveling. At the same time the glide 68 and its disposition under and adjacent each end of the front and rear tubular wall structures 54 hence enables the glides to be disposed closely adjacent the front and rear sides of the cabinet, in the vicinity of the corners thereof, so as to optimize the stability and support of the cabinet when disposed in a normal upright supportive engagement with a floor.

In the illustrated construction of the housing, the base 51 as illustrated in FIG. 7 preferably has a recess 67 defined at each corner thereof, which recess 67 is created by effectively terminating the front tubular structure 54 such that it does not project all the way to the outer peripheral edge of the tubular edge wall structure 56. The corner recess 67 accommodates the upright rounded front corner 16 associated with the sidewall arrangement of the housing, and also accommodates the rounded rear corner 15 where the rear and side walls join, inasmuch as the housing side and rear walls project vertically downwardly so as to overlap the exterior peripheral walls of the base substantially as illustrated in FIGS. 4 and 5.

To effect assembly of the base to the housing wall structure 13-14, the upper box member 61 is positioned within the lower end of the U-shaped wall structure defined by rear wall 13 and side walls 14 such that the lower peripheral edge portions of these latter walls overlap the side and rear peripheral upright walls 57 as illustrated in FIGS. 4-5. These overlapping walls are then suitably secured together, such as by spot welding. The latter is preferably carried out from inside the hollow upper box 61. Thereafter the lower box 62 is slidably nested inside the upper box 61 and maintained with the top flanges 66 thereof seated against the top wall 52, following which the lower box 62 is welded to the guide flanges 64 to rigidly join the nested boxes 61-62 together, with the resulting box structure itself being rigidly joined to the upright side and rear walls associated with the housing.

With the construction of the housing 12 as described above, the definition of the housing by the rear and side walls and the securement thereof to the hollow boxlike base 51, together with the securement of the side and rear walls to the top wall 41, accordingly defines the housing as a generally large but hollow box which is open on the front side thereof, but which hollow box possesses significant strength and rigidity so as to permit it to accommodate significantly heavy loads as imposed thereon by loaded drawer units 24, while at the same time resisting significant racking or transverse displacement of the housing. The closed boxlike structure of the base 51, and specifically the provision of the closed tubular wall structures 54 extending longitudinally along the front and rear edges of the base, provides the base with a high degree of rigidity such that the base when coupled to the side and rear walls of the housing hence cooperate to provide a high degree of stiffness which greatly minimizes the tendency of the top of the housing to laterally displace (i.e. rack) relative to the base. At the same time the closed edge wall structures 56 which extend lengthwise along the end edges, namely in the depth direction of the housing, are disposed directly under the uprights 31-34 on which the load-bearing drawer units are supported, and these tubular edge wall structures 56 additionally are secured to the lower portions of the side walls 14, whereby the base additionally provides increased strength and rigidity with respect to transference of loads into the base and thence into the floor-engaging glides 68 so as to minimize deflection or distortion of the housing.

The construction of the base 51, by forming same from opposed nested upper and lower box members 61 and 62, is further advantageous by not only simplifying the construction of the base and the number of parts utilized to form the base, but by also permitting optimization with respect to the selection of material and/or material thickness. For example, the upper and lower box members 61 and 62 are each preferably formed as monolithic one-piece structures by being formed from thin metal sheet, but these two box members can be formed from different gauge or thickness of metal sheet. In this respect, it is preferable that the upper box member 61 be initially formed from metal sheet having a greater thickness than that utilized to define the lower box member. In a preferred construction the upper box member 61 is formed from 18 gauge steel sheet, whereas the lower box member 62 is formed from 22 gauge steel sheet.

Considering now the mounting of the drawer slides on the uprights 31-34, and referring specifically to FIGS. 9-12, there is illustrated the disposition of a drawer slide 25 as associated with one side of a drawer unit 24, and specifically the positioning of the drawer slide relative to the front and rear uprights 32, 34 associated with one of the side walls 14.

The drawer slide 25 includes an outer channel-like housing or rail 71 which is adapted to be stationarily mounted on and extend horizontally between the front and rear rails 32, 34. This outer rail 71 telescopically and slidably mounts therein an intermediate slide 72, the latter in turn telescopically slidably mounting therein an outer slide 73, the latter being fixed to the side wall of the drawer unit in a conventional manner.

The overall construction of the telescopic slide 25 is conventional, and may assume many known conventional constructions so that further description thereof is believed unnecessary.

To mount the telescopic slide 25 on the uprights in accordance with the housing construction of the present invention, the vertical wall of the slide rail 71 is provided with a rear mounting flange 74 and a front mounting flange 75 which are respectively configured to engage the respective rear upright 34 and front upright 32. The rear mounting flange 74 is integrally formed from the rail 71 and is joined to the rail through an offset wall 77 so that the rear mounting flange 74 is cantilevered rearwardly from the offset 77 and is spaced sidewardly a small distance from the outer surface of the rail 71.

In similar fashion the front mounting flange 75 is formed integral with and offset outwardly from the outer side of the rail 71. For this purpose the front mounting flange 75 is joined to the rail through an offset wall 78, with the flange 75 being cantilevered so as to project in a downward direction from the offset wall 78. The front flange 75 projects generally downwardly relative to the horizontal or longitudinally extending centerline 76 of the slide rail 71, whereas the rear mounting flange 75 is disposed so that it is oriented generally above the centerline 76.

The mounting flanges 74-75 are adapted for cooperation with the identical openings 38 provided in the front and rear uprights 32, 34, which openings are rectangular and in the disclosed embodiment are square. The identity of the uprights 32, 34 and their disposition within the housing results in the individual openings 38 in the front rail 32 being generally horizontally aligned with their respective individual openings 38 in the rear upright 34.

To mount the slide unit 25 to the respective side wall 14, the slide rail 71 is oriented horizontally and is positioned closely adjacent the uprights such that the rear mounting flange 74 is generally aligned with a selected one of the openings 38 in the rear upright 34. The slide rail 71 is then moved toward the uprights so that the rear flange 74 passes through the aligned opening 38, following which the rail 71 is moved rearwardly so that the flange 74 overlaps behind the base wall of the upright, causing the rear edge of the opening 38 to effectively abut the offset wall 77. When in this disposition, the slide rail 71 is angled slightly upwardly as it projects forwardly so as to cause the front flange 75 to align with a corresponding opening 38 in the front upright 32. The front end of the rail 71 is then moved inwardly so that the front flange 75 passes through the aligned opening 38. The rail 71 is then tilted downwardly about the rearward end thereof, thus causing the front flange 75 to pass downwardly into overlapping relationship behind the base wall of the upright 32, which downward tilting continues until the bottom edge of the opening 38 effectively abuts the offset wall 78. When reaching this latter position, the front and rear flanges are hence properly seated on the respective front and rear uprights, and can not be readily dislodged except by reversing the sequence of motions described above.

It will be appreciated that right and left slide rails 71 are effectively mirror images of one another so as to be engageable with the uprights on the respective right and left side walls 14.

While the construction of the housing 12 associated with the disclosed embodiment involves forming the rear and side walls from one piece of metal sheet, it will be appreciated that the housing can also be formed from side and rear walls which are initially separate elements and which are suitably joined together during assembly of the housing, and that the improved base as well as the improved uprights as disclosed herein are particularly suitable for use with a housing employing separately-formed side and rear wall constructions. In addition, it will be further appreciated that the closed box base need not be provided with corner recesses, depending upon the configuration of the side and rear wall structures, and in fact maintaining solid corners on the base in most circumstances is preferred since such solid corners provide additional reinforcement for the housing at the corners.

With the drawer-type storage cabinet of the present invention, it will be appreciated that such cabinet will typically have a width (i.e., the longitudinal extent of the cabinet as defined between the opposed side walls) which is typically at least two to three times greater than its depth (i.e., the transverse front-to-back dimension), and such cabinet when used in a typical three-to-five drawer arrangement will have a height which will be in the range of from two to four times the cabinet depth.

Another embodiment of a storage cabinet according to the present invention, and specifically a drawer-type lateral file cabinet, will hereinafter be described with reference to FIGS. 13-29. The embodiment described in these latter figures, in comparison to the previous description with respect to FIGS. 1-12, utilizes the same reference numerals to designate corresponding parts except that such reference numerals are increased by "100".

FIGS. 13-16 illustrate therein a free-standing storage cabinet 111, specifically a drawer-type lateral file cabinet. The storage cabinet 111 includes an upright hollow boxlike housing 112 having an upright rear wall structure 113 which is rigidly joined between a pair of opposed and generally upright sidewall structures 114. The upright wall structures 113 and 114 have a top wall structure 122 fixed thereto for closing off the upper end of the housing, and a base or bottom wall structure 123 joins to the upright wall structures for closing off the bottom of the housing. The boxlike housing 112 defines, on the front side 118 thereof, a large front opening 119 which accesses the hollow interior 121 of the housing.

The storage unit in the illustrated embodiment has plural, here two, drawer units 124 which are horizontally slidably supported within the storage unit and positioned generally vertically one above the other. The drawer units typically have individual front walls 126 which are disposed within and generally close off the front access opening 119 of the housing when the drawer units are in a closed position.

While the embodiment of FIGS. 13-16 illustrates the cabinet having only two drawer units, it will be appreciated that the number of vertically disposed drawer units, and the overall height of the cabinet, can be varied in accordance with specific demands, particularly since such cabinets are often provided with up to at least five drawers positioned vertically one above the other, similar to the arrangement illustrated by FIG. 1.

In the improved cabinet housing 112, the upright walls of the housing are formed principally by the rear wall structure 113 and the pair of opposed sidewall structures 114, each of which is of a one-piece construction, whereby these three pieces hence rigidly join so as to define the upright wall construction of the housing.

The pair of opposed sidewall structures 114 are, as described in greater detail hereinafter, identical and are also symmetrical (i.e., mirror images) when viewed about the vertically extending centerline 196 so that the side wall structures are hence free of "right" and "left" restrictions. More specifically, each sidewall arrangement as illustrated principally by FIGS. 17-19 includes a vertically enlarged, sheetlike and planar exterior side wall 181 formed from a conventional sheet material such as steel sheet. The sidewall structure 114 also includes a pair of upright channel structures 131 and 133 fixedly associated with the sidewall structure so as to extend vertically along opposite vertically extending edges thereof. The upright channels 131 and 133 are also substantially identical in that they effectively constitute mirror images of one another when viewed relative to the vertically extending centerline 196.

Figure 19:
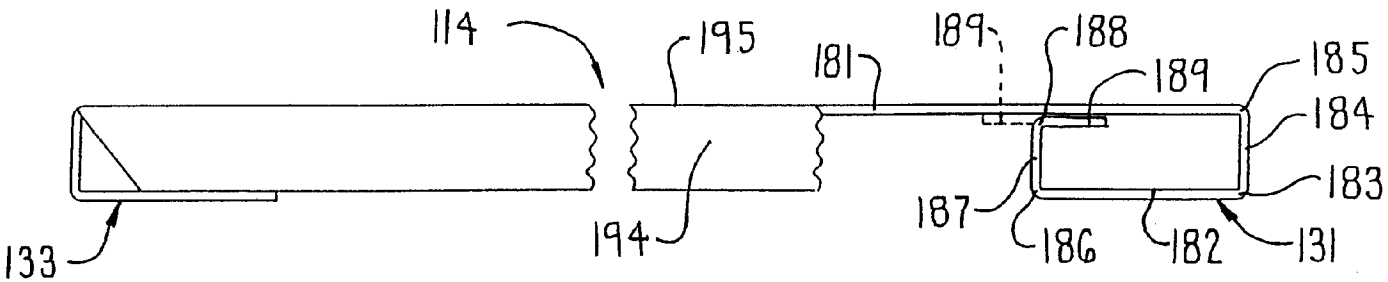
FIG. 19 is a fragmentary top view of the sidewall structure shown in FIG. 17.

Considering now the construction of the upright channel 131 in greater detail, and referring specifically to FIG. 19, this channel is effectively defined by an upright U-shaped wall which cooperates with the exterior side wall 181 so as to define a substantially closed tube of generally rectangular cross section. The upright channel 131 includes an upright base wall 182 which is spaced inwardly from but extends generally parallel with the exterior side wall 181, with the base wall 182 having a horizontal width in the front-to-rear direction of the cabinet which is small relative to the overall depth of the cabinet. The base wall 182 is joined through one vertically-extending rounded corner or bend 183 to an outer flange 184 which extends vertically generally throughout the length of the sidewall arrangement 114. This outer flange 114 in turn is joined through a further bent or rounded corner 185 to one vertical edge of the exterior side wall 181.

In similar fashion the other vertical edge of the base wall 182 is joined at a rounded corner or bend 186 to an inner flange 187 which projects toward the exterior side wall 181 and which extends generally in parallel relationship to the outer flange 184. The inner flange 187 in turn joins through a further rounded corner or bend 188 to a cantilevered edge flange 189 which extends in transverse relationship so as to substantially directly overlie the inner surface of the exterior side wall 181. The cantilevered edge flange 189 is suitably fixed to the exterior side wall 181, such as by a vertically spaced series of spot or tack welds, so that the upright channel 131 is rigidly associated with the exterior side wall 181.

The cantilevered edge flange 189 as illustrated by solid lines in FIG. 19 is bent so as to be positioned interiorly of the upright channel so as to provide a cleaner appearance. However, the flange 189 can be bent so as to project transversely in the opposite direction if desired, such as illustrated by dotted lines in FIG. 19.

The upright channel 131 has a series of openings 191 formed in and extending through the base wall 182, which openings are disposed in generally uniformly vertically spaced relationship and are oriented to define a vertically extending row. In the illustrated embodiment, the openings 191 are disposed in close association to the inner flange 187, whereby the openings hence are disposed generally horizontally aligned with the cantilevered edge flange 189. This hence enables a welding contact member to be inserted through the openings 191 so as to effect welding of the edge flange 189 to the exterior side wall 181.

The upright channel 131 has, adjacent the lower end thereof, a cutout 192 (FIGS. 17-18) which involves removal of a lower portion of the base wall 182 as well as the flanges 187 and 189. This cutout 192 results in the defining of a lower edge 193 associated with the lower end of the base wall 182, inner flange 187 and edge flange 189, which lower edge 193 is spaced upwardly from the lower edge 190 of the exterior sidewall 181 by a vertical distance which approximately corresponds to the thickness (i.e. height) of the bottom wall structure 122, the latter having its corner structure adapted to fit within this cutout when the cabinet housing is assembled.

Figure 18:
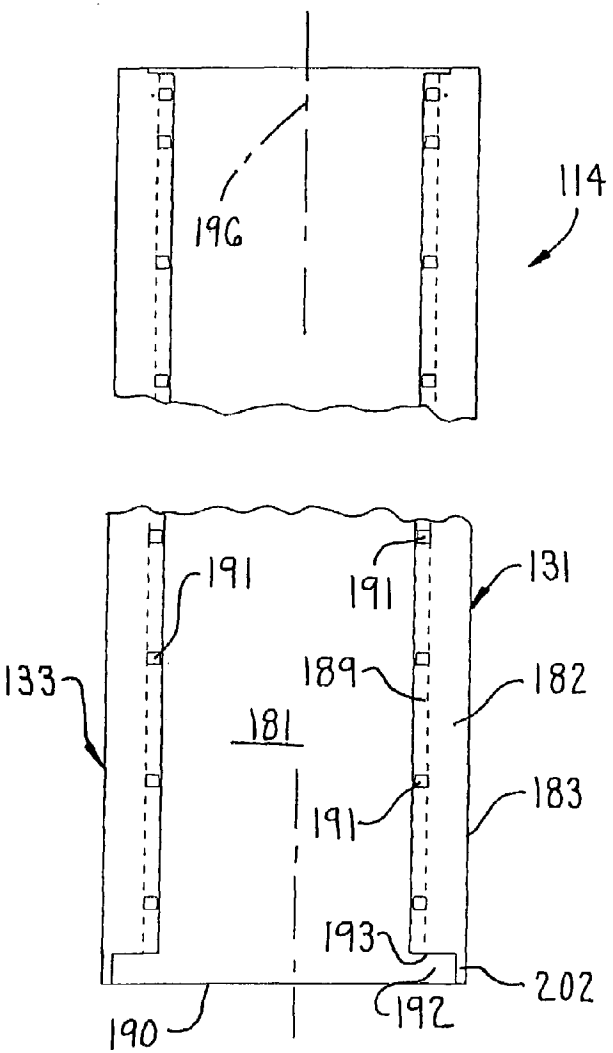
FIG. 18 is an inside elevational view of the upright sidewall structure shown in FIG. 17.
Figure 17:
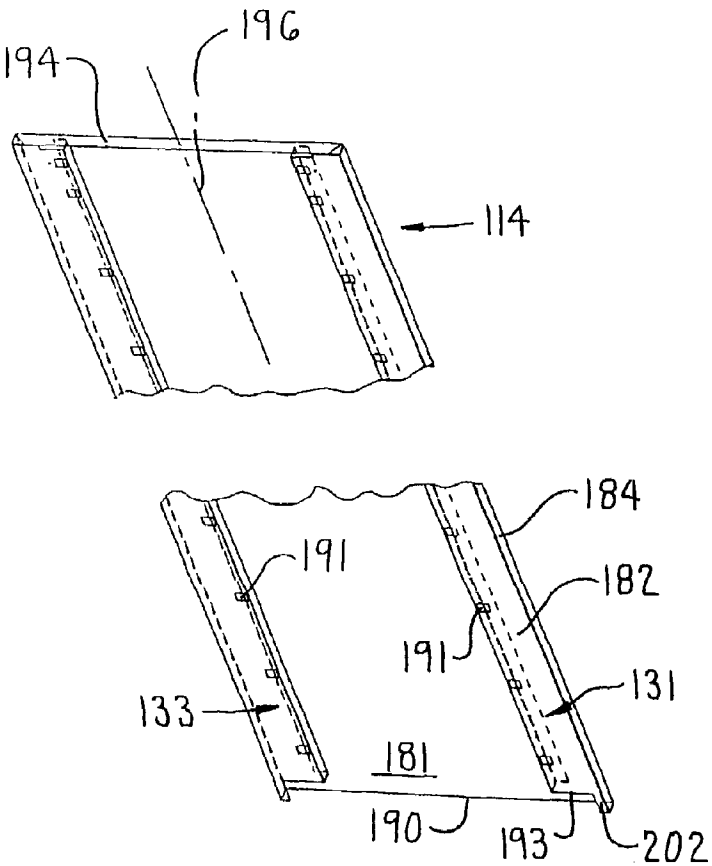
FIG. 17 is a perspective view of the upright sidewall structure associated with the cabinet of FIG. 13.
Figure 23:
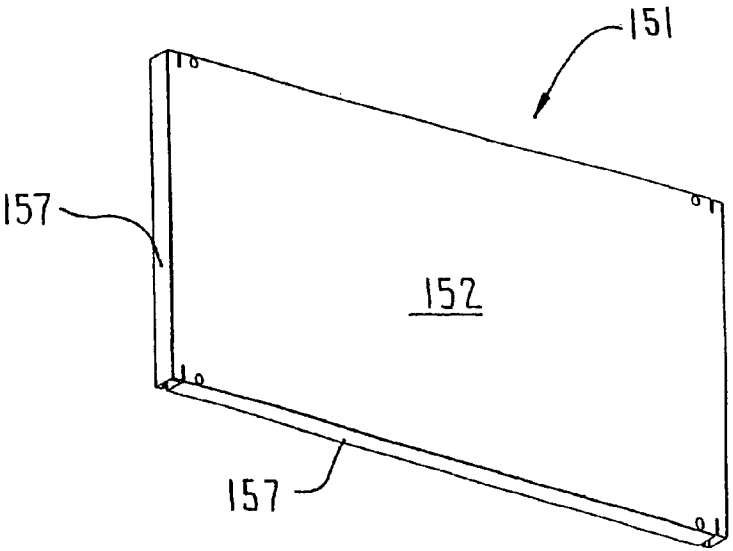
FIG. 23 is a perspective view of solely the base or boxlike bottom wall structure for the cabinet of FIG. 13.

As illustrated by FIGS. 17 and 18, the cutout 192 does not extend across the full width of the base wall 182, but rather terminates short of the outer flange 184, thereby leaving a small tab or wall 202 which is effectively coplanar with the base wall 182 and which extends downwardly to the elevation of the lower edge 190. This tab 202 cooperates with the bottom wall structure as explained hereinafter.

The side wall structure 114 also has a top edge flange 194 which is joined through a rounded corner or bend 195 to the upper edge of the exterior side wall 181. This flange 194 is cantilevered inwardly with respect to the exterior side wall 181 and extends generally along the horizontal upper edge thereof, whereby top flange 194 effectively overlies the upper ends of the upright channels 131, 133.

The upright channel 133 associated with the other vertical edge of the sidewall structure 114 is identical to the upright channel 131 as described above, except for being a mirror image thereof as defined about the vertical centerline 196. The side wall structure 114 when viewed in cross section, relative to the centerline 196, is hence wholly symmetrical and accordingly does not possess any right or left orientation characteristics. Thus, two identical sidewall structures 114 can be used to construct the housing 112, and the sidewall structure 114 can be used to define both the right and left sides of the housing 112.

The sidewall structure 114 including the exterior side wall 181 and the associated upright channels 131 and 133 are also preferably formed as an integral, monolithic one-piece member formed entirely from a single flat metal sheet so as to provide optimum strength and tolerance characteristics while minimizing use of material and resulting weight, and minimizing the number of distinct parts and assembly operations.

The sidewall arrangement 114 according to one preferred embodiment can be formed using a conventional roll forming process. For example, a flat metal sheet can be punched or stamped in a conventional means to create the desired openings, slots and notches therein, such as the openings associated with the uprights. The flat sheet can then be passed through a progressive series of rolling stages, which are utilized to progressively form the folded-over upright channels 131, 133 along opposite edges of the sheet. Upon completion of the roll forming operation, the formed flanges 189 can then be welded to the exterior side wall 181.

In place of a roll forming operation, it will be appreciated that other forming operations involving conventional punching, stamping, bending and/or pressing steps can be utilized to effect forming of the upright channels 131, 133 as an integral part of the exterior sheet 181 if desired.

Figure 20:
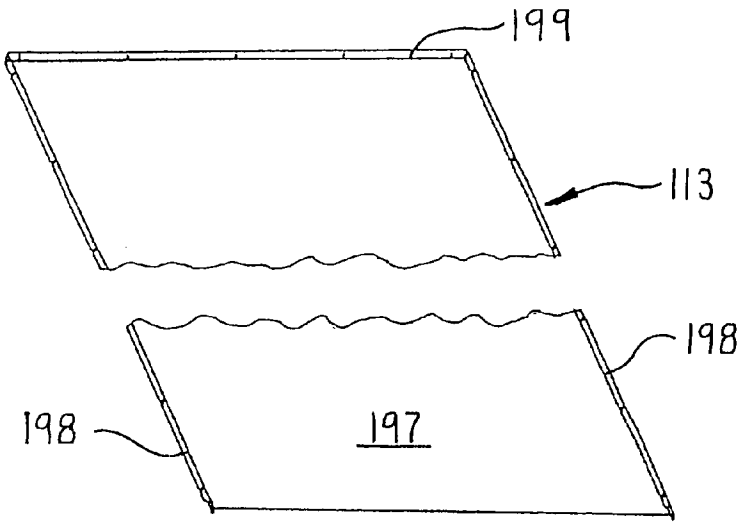
FIG. 20 is a perspective view of the back wall of the cabinet of FIG. 13.
Figure 22:
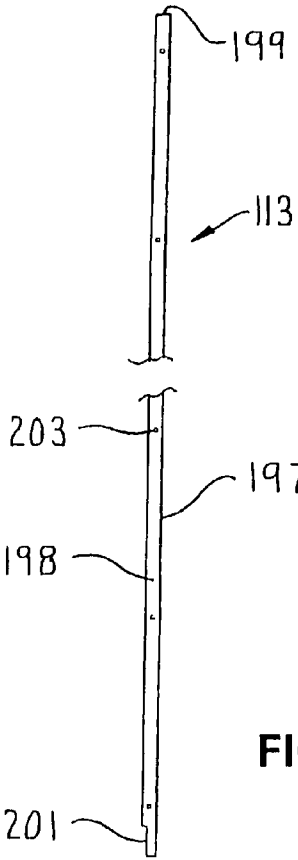
FIG. 22 is a side view of the back wall.
Figure 21:
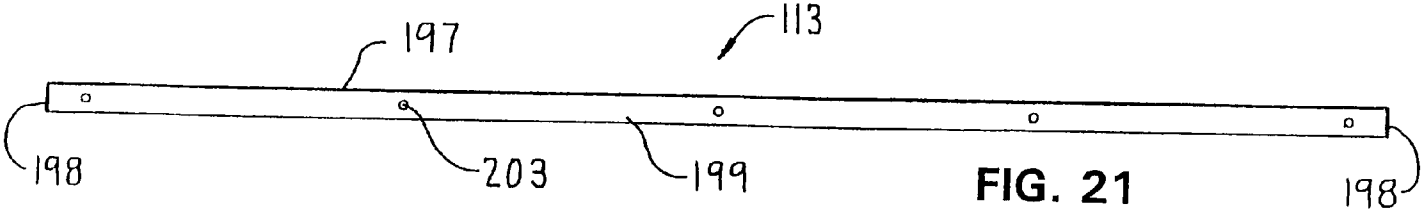
FIG. 21 is an enlarged top view of the back wall shown in FIG. 20.
Figure 24:
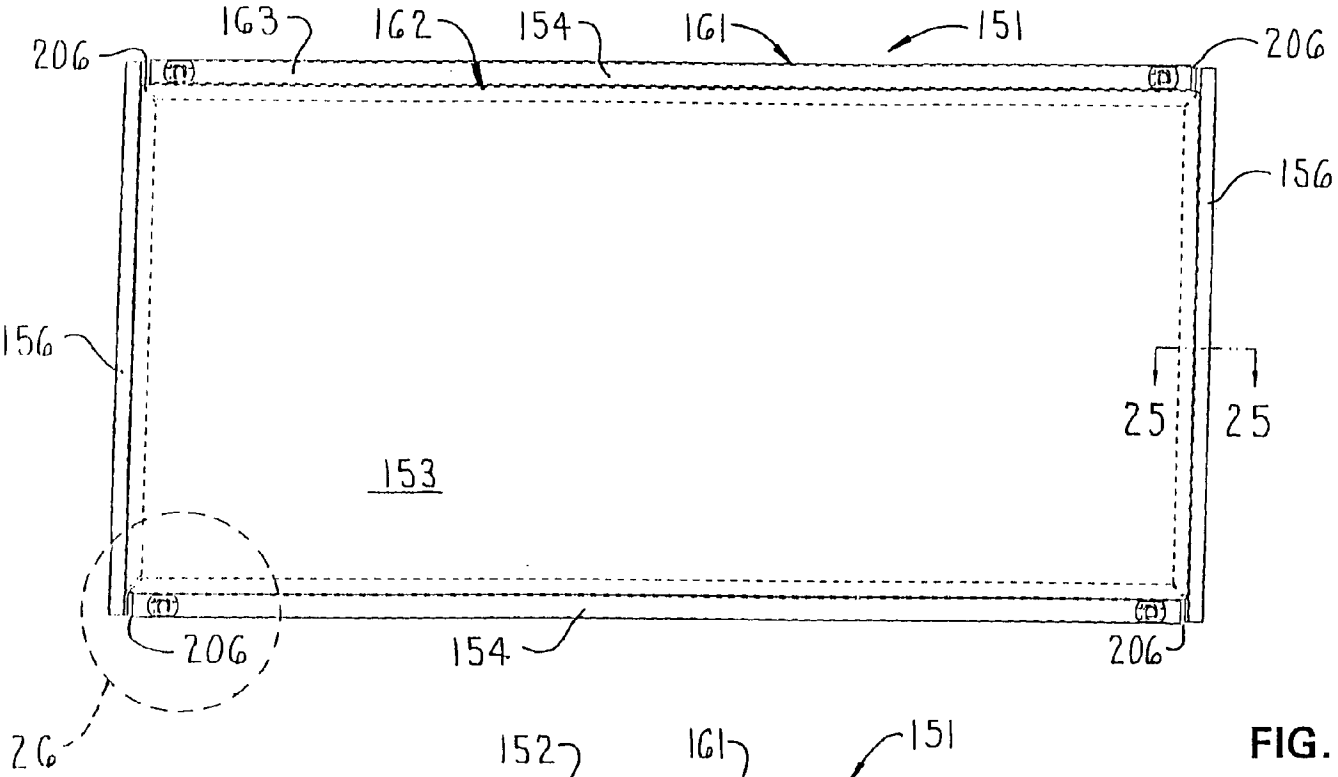
FIG. 24 is an enlarged bottom view of the base shown in FIG. 23.
Figure 25:
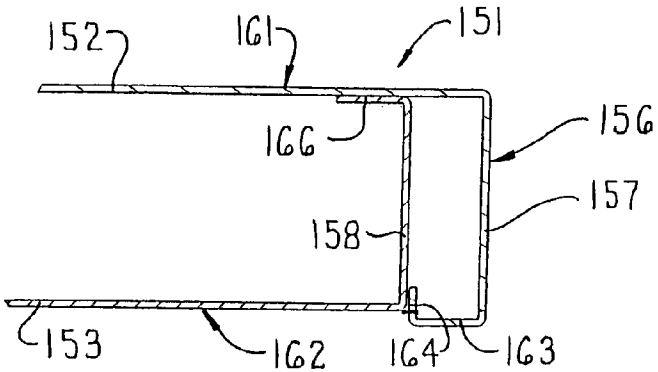
FIG. 25 is an enlarged fragmentary sectional view taken generally along line 25-25 in FIG. 24.

Considering now the rear wall structure 113, and referring to FIGS. 20-22, the latter is also preferably formed as an integral, monolithic, one-piece member by being suitably shaped from a flat metal sheet. This rear wall structure 113 includes a sheetlike planar exterior rear wall 197 which, adjacent the opposite vertical edges thereof, is provided with vertical edge flanges 198 which are transversely cantilevered forwardly, and a similar top edge flange 199 extends along the upper edge of the exterior rear wall 197 and is transversely cantilevered inwardly through a small horizontal extent. The vertical edge flanges 198, adjacent the lower ends thereof, are provided with a small cutout or notch 201 (FIG. 22) which projects upwardly from the lower edge of the rear wall through a height which generally corresponds to the height of the bottom wall structure 123 so as to accommodate the latter therein.

The edge flanges 198 and 199 associated with the rear wall structure 113 are normally provided with a series of openings 203 formed therethrough at spaced intervals therealong so as to accommodate fasteners such as screws or the like to facilitate securement of the rear wall structure 113 to the side and top wall structures 113 and 114.

Considering now the top wall structure 122, the latter is defined by a shallow, downwardly opening, boxlike cover member which substantially corresponds to the cover member 46 (FIG. 4) described above. More specifically, and referencing FIG. 29, this cover member includes a horizontally extending platelike top wall 147 which extends coextensively over the longitudinal and depth dimensions of the housing and which, at its peripheral edges, is bent downwardly to define a peripheral edge wall 148 which extends entirely around the periphery of the top wall and projects vertically downwardly through a small vertical extent. Edge wall 148 at its lower end is bent to define a horizontally inwardly cantilevered edge flange 149 which is adapted to be seatingly engaged on top of the top edge flanges 189 and 199 associated with the side and rear wall structures 14 and 13, respectively. These overlapping flanges are suitably fixedly secured together, such as by screws or other suitable fasteners.

If necessary or desirable from a strength and rigidity standpoint, the housing can also be provided with a top wall fixedly related thereto, such as the ribbed top wall member 41 illustrated in FIG. 4, the latter being disposed directly below the top cover and attached rigidly to top edge flanges associated with the side and rear wall structures.

Considering now the base or bottom wall structure, this structure as illustrated by FIGS. 23-28 is defined by a closed but hollow box structure 151 which is constructed substantially identical to the box structure 51 described above and illustrated in FIGS. 6-8. For this reason the details of the construction of the box structure 151 will not be described in detail.

Figure 26:
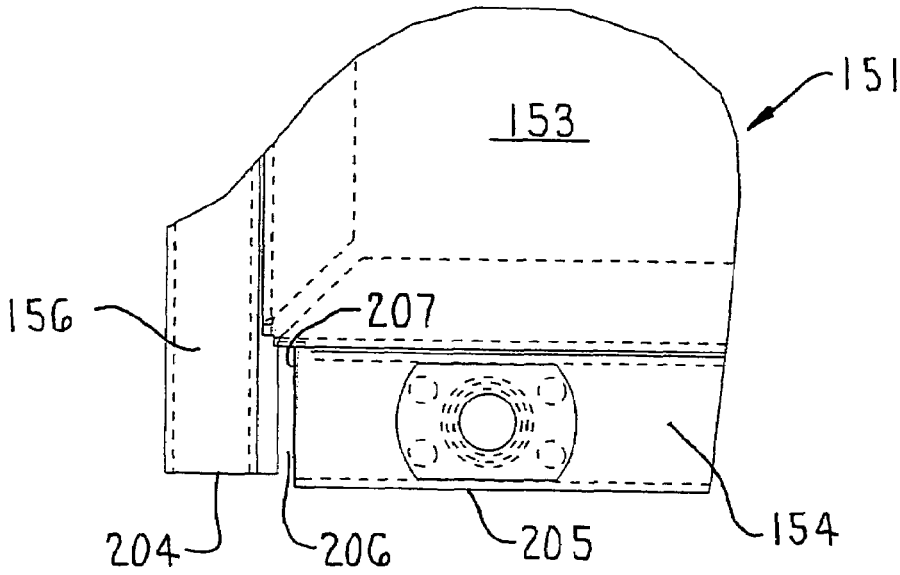
FIG. 26 is an enlarged view of the corner of the base as appearing in the circle designated 26 in FIG. 24.
Figure 27:
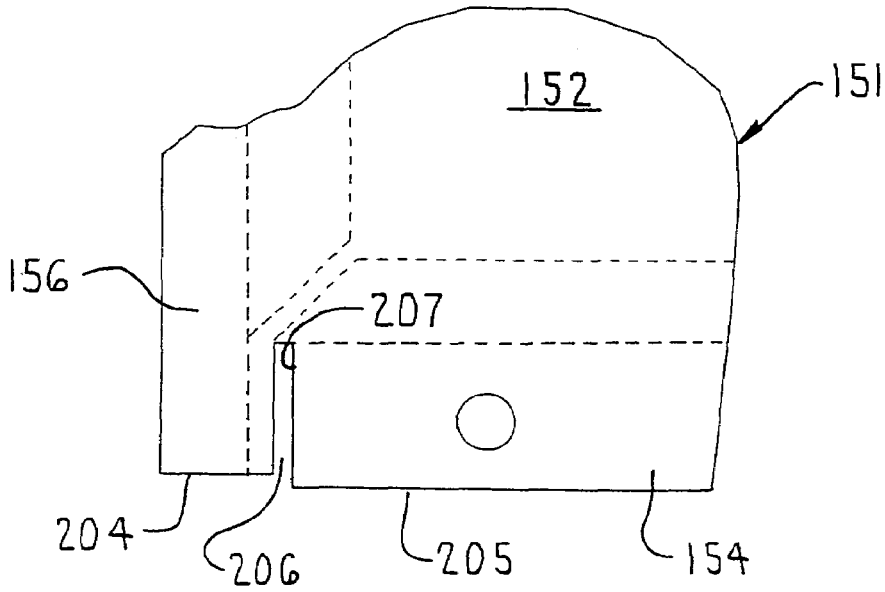
FIG. 27 is a top view of the corner of the base shown in FIG. 26.

However, whereas the corners of the box structure 51 (FIGS. 6-8) have recesses 67 associated therewith, the hollow box structure 151 associated with this embodiment of the cabinet housing is not provided with such corner recesses. Rather, as illustrated in FIGS. 26-27, the closed tubular arrangements 156 which extend along each of the side (i.e. transverse) edges of the base extend substantially throughout the entire transverse width of the base so that these tubular wall arrangements 156 terminate at end edges 204 which are located substantially flush with but spaced inwardly only a small distance from the outer side surface 205 of the longitudinally extending tubular wall arrangements 154. In addition, the longitudinally extending wall arrangement 154 terminates at an end edge 207 which is spaced a small distance from the inner wall of the transversely extending tubular wall arrangement 156, thereby defining a narrow clearance slot 206 therebetween which opens transversely inwardly from the longitudinal outer surface 205 through a depth which generally corresponds to the horizontal width of the tubular arrangement 154. This slot 206 thus opens vertically through the hollow boxlike structure 151.

Figure 28:
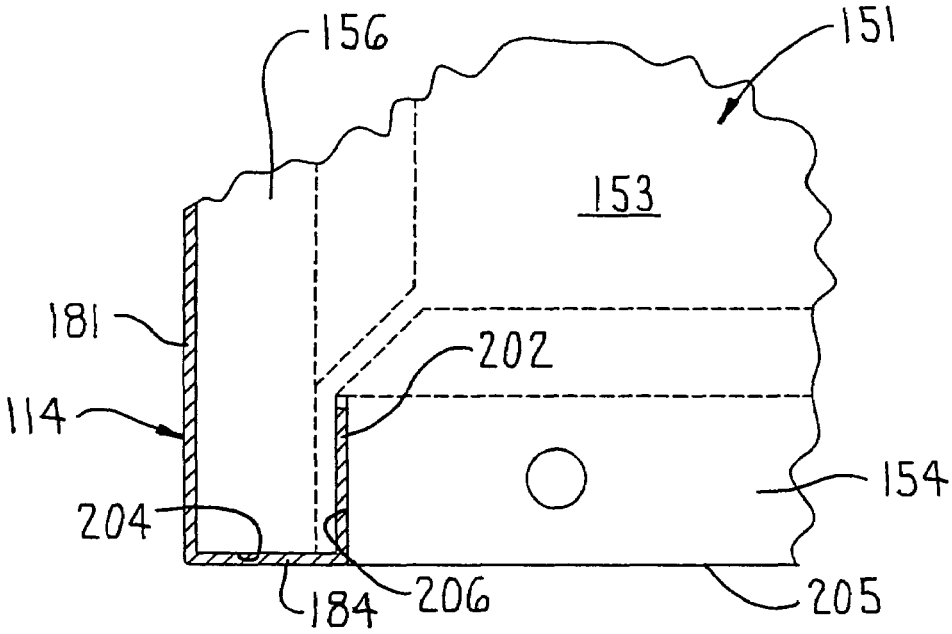
FIG. 28 is a view similar to FIG. 26 but illustrating the edge channel in cross section.
Figure 29:
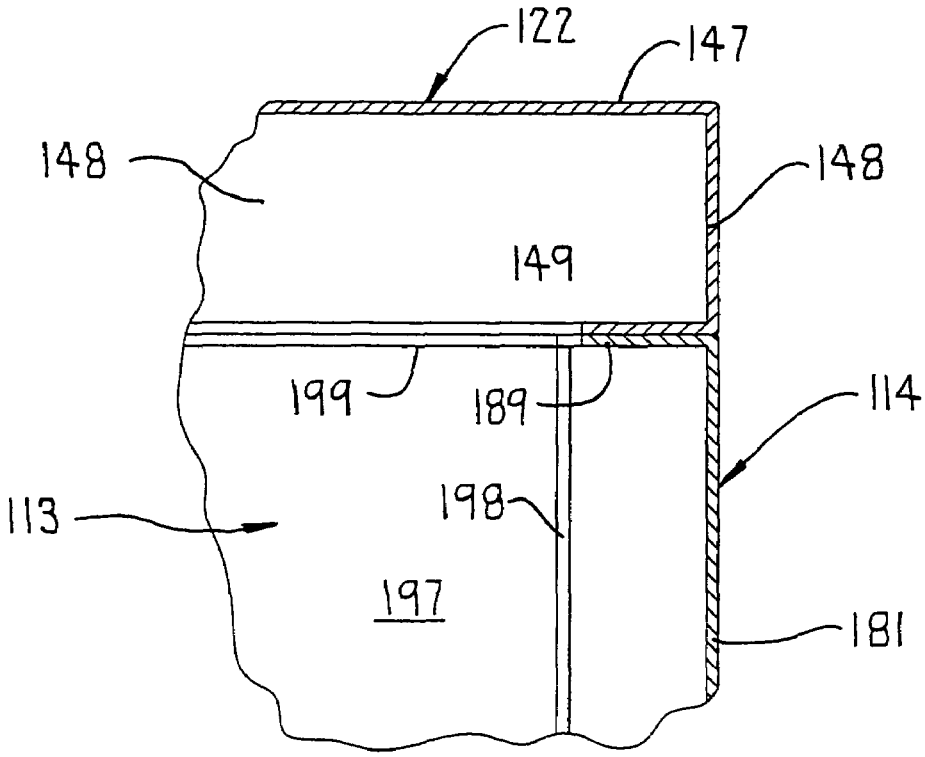
FIG. 29 is an enlarged fragmentary view which illustrates the manner in which the top wall member fits onto flanges associated with the upper edges of the side and back walls of the cabinet.

Due to extension of the transverse tubular wall arrangements 156 to locations disposed adjacent the outer corners of the closed box, coupled with the provision of the transverse slots 206 which open transversely inwardly from the longitudinal sides of the box adjacent each of the corners thereof, these relationships enable each corner of the box to cooperatively engage a lower corner associated with one of the sidewall arrangements 114. For example, as illustrated by FIG. 28, the lower part of the exterior side wall 181 overlaps the exterior side surface of the tubular wall arrangement 156, and the outer edge flange 184 at the lower end thereof projects along the end surface 204 of tubular wall arrangement 156 so that the exterior surface of the edge flange 184 is substantially flush with the outer face 205 of the longitudinal tubular wall arrangement 154. At the same time the transverse wall tab 202, which is substantially coplanar with the upright base wall 182, projects into the narrow slot 206 to assist in fixedly interconnecting the side wall arrangements 114 and the base 151.

In addition to providing a fixed connection between the sidewall structures and the base, the afore-described arrangement also provides significantly enhanced strength and rigidity at the lower corners of the cabinet since the tubular wall arrangement 156 extends directly behind and effectively reinforces the edge flange 184 directly adjacent the lower corner of the housing, which corner is subjected to significant impact and abuse, whereby significantly improved performance can be achieved from this reinforced corner structure. Since this same structural arrangement exists at all four corners of the housing, the overall strength and rigidity associated with the corners of the housing can significantly prevent damage which would otherwise be experienced during shipping and movement of the cabinet.

With the improved housing for a storage cabinet as defined above, and as illustrated by FIGS. 13-29, the overall housing possesses strength and rigidity so as to have significant resistance against racking, and at the same time the housing is formed from a minimal number of individual members which significantly reduces the number of individual but different parts which must be manufactured, inventoried and assembled so as to create the housing. This desirable result is achieved without causing any significant increase in weight of the overall housing.

More specifically, by forming the sidewall structures as integral and monolithic one-piece members wherein the uprights are integrally and monolithically joined to the exterior side wall, for example, by roll forming from a flat metal sheet, the entire sidewall structure is effectively a one-piece member, rather than being formed from three separate members as is done in many conventional constructions. At the same time, by forming the uprights on each sidewall as mirror images of one another, the right and left sidewall structures for the housing can be identical, whereby only one member is required and can be used for either the right or left sidewall, thereby further minimizing the manufacturing and assembling of the housing.

This improved cabinet housing, as discussed above, is also highly advantageous in that it is readily adaptable for forming of housings of different lengths since the same monolithic one-piece sidewall structure can be utilized for defining the right and left sides of housings of various lengths, with the length of the housing being adjusted by varying the length of solely the one-piece top wall, the one-piece back wall, and the one-piece top and bottom housing members which cooperate to define the closed hollow base.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An upright multiple-drawer storage cabinet, comprising:

an upright hollow housing having an upright wall arrangement including generally parallel but sidewardly spaced separate right and left upright sidewall structures which are joined by an upright rear wall structure, the housing defining therein an interior chamber, and a front side of the housing defining therein an access opening for accessing said interior chamber;

each said sidewall structure having an enlarged and generally planar upright exterior sidewall;

each said sidewall structure also having front and rear vertically elongate and parallel uprights at an inside surface of said exterior sidewall so that the front and rear uprights on one said sidewall structure are disposed generally in opposed and facing relationship to the respective front and rear uprights of the opposite sidewall structure, each of said front and rear uprights having a plurality of vertically-spaced openings extending horizontally therethrough, and each said sidewall structure having a generally horizontally-extending unfolded edge between corresponding ends of said front and rear uprights;

each said right and left sidewall structure being identical, and wherein the front and rear uprights are mirror images of one another as defined about a vertically extending centerline of the respective sidewall structure so that each said sidewall structure may function as either a right or left said sidewall structure of the housing;

a plurality of horizontally movable drawer units positioned within the interior chamber of the housing in vertically adjacent relationship one above the other, each said drawer unit having a pair of horizontally elongate slide units fixed to opposite sides thereof, each said slide unit having a rail structure provided with front and rear flanges which respectively engage in one of the openings respectively associated with the front and rear uprights associated with an adjacent said sidewall structure; and each said sidewall structure, including the exterior sidewall and the respective uprights, being a monolithic, one-piece structure formed from a single flat metal sheet.

2. A cabinet according to claim 1, wherein each of said front and rear uprights is a generally channel-shaped member which is positioned adjacent and extends generally vertically along a respective vertically-extending edge of the exterior sidewall so that a leg of the respective front and rear channel shaped member respectively defines a front and rear surface of the respective sidewall.

3. A cabinet according to claim 2, wherein the sidewall structure is roll-formed from said flat metal sheet.

4. A cabinet according to claim 1, wherein said horizontally-extending unfolded edge is free from flanges or channel members.

5. A cabinet according to claim 1, wherein said rear wall structure is defined by a monolithic, one-piece structure having a generally planar upright rear wall provided with flanges extending along opposite vertical edges thereof so that said rear wall fits between and is rigidly secured to said right and left sidewall structures during assembly of said housing.

6. The cabinet according to claim 1, further comprising a separate top wall structure extending horizontally across an upper end of said upright wall arrangement and fixedly joined thereto for closing off the upper end of the housing.

7. An upright multiple-drawer storage cabinet comprising:

an upright hollow housing having an upright wall arrangement including generally parallel but sidewardly spaced right and left upright sidewall structures which are joined by an upright rear wall structure, the housing defining therein an interior chamber, and a front side of the housing defining therein an access opening for accessing said interior chamber;

the housing having a horizontally enlarged base fixed to and closing off a lower end thereof, said horizontally enlarged base being defined by a closed but rigid hollow box structure which defines a horizontally extending footprint of the housing for supportive engagement with a floor, the hollow box structure being defined by a one-piece monolithic upper box member which opens downwardly and a separate one-piece monolithic lower box member which opens upwardly, said upper and lower box members being vertically telescopically nested one within the other and fixedly secured together to define an open interior therebetween;

each said sidewall structure having an enlarged and generally planar upright exterior sidewall;

each said sidewall structure also having front and rear vertically elongate and parallel uprights at an inside surface of said exterior sidewall so that the front and rear uprights on one said sidewall structure are disposed generally in opposed and facing relationship to the respective front and rear uprights fixed to the opposite sidewall structure, each of said front and rear uprights having a plurality of vertically-spaced openings extending horizontally therethrough;

a plurality of horizontally movable drawer units positioned within the interior chamber of the housing above said base including said box structure, and in vertically adjacent relationship one above the other, each said drawer unit having a pair of horizontally elongate slide units fixed to opposite sides thereof, each said slide unit having a rail structure provided with front and rear flanges which respectively engage in one of the openings respectively associated with the front and rear uprights associated with an adjacent said sidewall structure; and each said sidewall structure, which includes the exterior sidewall and the uprights, being a monolithic, one-piece structure formed from a single flat metal sheet.

8. A cabinet according to claim 7, wherein said hollow box structure has narrow slots which open vertically therethrough and open inwardly a limited extent from front and rear edge surfaces thereof in the vicinity of each corner, and each said sidewall structure adjacent a lower corner thereof having a generally L-shaped flange which wraps around the corner of the hollow box structure and projects into the respectively adjacent slot.

9. A cabinet according to claim 7, wherein the opposed upper and lower box members have edge walls which cooperate to define elongate tubular structures which extend horizontally lengthwise along respective peripheral edges of the hollow box structure.

10. A cabinet according to claim 7, wherein the opposed upper and lower box members have edge walls which extend therearound and which cooperate to define elongate tubular structures which extend horizontally lengthwise along the front, rear and both side peripheral edges of the hollow box structure.

11. An upright storage cabinet, comprising:

a rigid upright housing defining therein a hollow interior, said housing having a pair of generally parallel upright sidewall structures which at upper and lower ends are rigidly joined by respective top and bottom wall arrangements and which are secured to a rear wall for closing off a rear side of the housing, the housing on the front side thereof being defined by a front access opening which extends both vertically and horizontally over a substantial majority of the front side of the housing for allowing access to the hollow interior thereof;

said bottom wall arrangement being defined by a closed but rigid hollow box structure which defines the horizontally extending footprint of the housing for supportive engagement with a floor, said hollow box structure being defined by a one-piece monolithic upper box member which opens downwardly and telescopes with a separate one-piece monolithic lower box member which opens upwardly, said upper and lower box members being vertically nested and fixed together to define an open interior therebetween;

said hollow box structure having a narrow slot which opens transversely inwardly from a longitudinally-extending front and rear side face of the box structure in closely adjacent relationship to each corner thereof, said slot also opening vertically upwardly of the hollow box structure;

said sidewall structure including a generally planar upright exterior sidewall having a pair of uprights adjacent an inside surface thereof and extending vertically along opposite upright edges thereof, said uprights having openings in vertically spaced relation therealong;

each said sidewall structure also including a generally L-shaped flange associated with each lower corner of said exterior sidewall and cooperating with a corner of the hollow box structure so that the L-shaped flange has one leg thereof extending along the face of the box corner and the other leg of the L-shaped flange projecting into the respective slot so that the exterior wall and the respective L-shaped flange cooperate to reinforce the respective corner.

12. A cabinet according to claim 11, wherein each said sidewall structure including the associated uprights is formed as a monolithic one-piece structure formed from a single piece of metal sheet.

13. A cabinet according to claim 12, wherein the right and left sidewall structures are identical and each can be used to define either a right or left sidewall arrangement of the housing.

14. An upright housing for a storage cabinet, comprising:

an upright wall arrangement including generally parallel but sidewardly spaced right and left upright sidewall structures which are joined by an upright rear wall structure, the housing defining therein an interior chamber, and a front side of the housing defining therein an access opening for accessing said interior chamber;

a top wall structure extending horizontally across an upper end of said upright wall arrangement and fixedly joined thereto for closing off the upper end of the housing;

a horizontally large base fixed to and closing off a lower end of said upright wall arrangement, said base defining a horizontally extending footprint of the housing for supportive engagement with a floor;

said base defined by a closed but rigid hollow box structure having generally horizontal top and bottom walls disposed in closely adjacent but vertically spaced relationship and rigidly joined by peripheral edge walls which extend vertically between the top and bottom walls and horizontally along substantially the entire peripheral edges thereof, the hollow box structure having a transverse slot opening horizontally inwardly thereof in the vicinity of each corner thereof;

each said sidewall structure having an enlarged and generally planar upright exterior sidewall;

each said sidewall structure also having front and rear vertically elongate and parallel uprights of generally channel-shaped cross section at an inside surface of said exterior sidewall so that the front and rear uprights on one said sidewall structure are disposed generally in opposed and facing relationship to the respective front and rear uprights at the opposite sidewall structure; and each said sidewall structure including the exterior sidewall and the uprights fixed thereto being a monolithic, one-piece structure formed from a single flat metal sheet.

15. A housing according to claim 14, wherein the peripheral edge walls associated with the hollow box structure and their cooperation with the top and bottom walls define elongate tubular structures which extend horizontally lengthwise along front, rear and both side edges of the hollow box structure.

16. A housing according to claim 14, wherein each said sidewall structure adjacent lower corners thereof is provided with L-shaped flanges which overlie the corners of the hollow box structure to effect reinforcement of the corners.

17. A housing according to claim 16, wherein the flange associated with each corner of the sidewall structure includes a cantilevered leg part which projects into the slot positioned adjacent the respective corner of the hollow box structure.

18. A process for forming a housing of a storage cabinet wherein the housing includes an upright sidewall arrangement having top and bottom wall arrangements fixed at respective upper and lower ends thereof, comprising the steps of:

providing an enlarged flat metal sheet having a flat center sheet portion which extends lengthwise of the sheet and is coplanar with and located between flat side sheet portions which terminate at opposite side edges of the sheet;

forming a series of openings through each of the side sheet portions in spaced relationship from the respective side edge;

forming each of the opposite side sheet portions of the flat sheet into a channel shaped part with at least some of said openings being associated with the channel shaped part;

folding each of said side sheet portions relative to the center sheet portion so that the respective channel shaped parts directly overlie at least a section of the center sheet portion;

fixing each said channel shaped part at an inner surface of said center sheet portion to define a monolithic one-piece sidewall structure defined by said flat center sheet portion having said channel shaped parts at the inner surface thereof and extending lengthwise therealong adjacent opposite edges; providing two identical said sidewall structures and positioning said sidewall structures in spaced and opposed parallel relationship so that the channel shaped parts are disposed in opposed and facing relationship, wherein the channel shaped parts of each said sidewall structure are mirror images of one another as defined about a vertically extending centerline of the respective sidewall structure so that each said sidewall structure may function as either a right or left side of the housing;

positioning and fixing an enlarged upright rear wall arrangement to rear edges of said left and right sidewall structures to define an upright wall arrangement;

closing off upper and lower ends of said upright sidewall arrangement by fixing respective top and bottom walls thereto; and maintaining a lower edge of each said sidewall structure in an unfolded condition for the formed housing.

19. A process for forming a housing according to claim 18, wherein each said monolithic one-piece sidewall structure is roll-formed from said flat metal sheet.

20. A process for forming a housing according to claim 18, wherein the openings in the side sheet portions are formed in each said channel shaped part and are aligned therealong to permit mounting of side rails associated with drawers.

21. A process for forming a housing according to claim 18, wherein the step of forming the series of openings comprises punching or stamping the flat metal sheet prior to forming of the channel-shaped parts.

* * * * *

UNITED STATES PATENT AND TRADEMARK OFFICE

CERTIFICATE OF CORRECTION

PATENT NO. : 7,275,797 B2
APPLICATION NO. : 10/657014
DATED : October 2, 2007
INVENTOR(S) : Dave Timmermann et al.

It is certified that error appears in the above-identified patent and that said Letters Patent is hereby corrected as shown below:

Column 18, line 1, change “channel shaped” to --channel-shaped--.

Column 21, line 14, the phrase “providing two identical said” is a new paragraph and is placed at the beginning of Column 21, line 15.

Signed and Sealed this

Seventeenth Day of June, 2008

JON W. DUDAS
*Director of the United States Patent and Trademark Office*